US012471650B2

(12) United States Patent
Kim

(10) Patent No.: US 12,471,650 B2
(45) Date of Patent: Nov. 18, 2025

(54) GLOVES AND/OR OTHER HAND-RECEIVING DEVICES WITH INFLATABLE COMPONENTS

(71) Applicant: NIKE, Inc., Beaverton, OR (US)

(72) Inventor: George S. Kim, Wilsonville, OR (US)

(73) Assignee: NIKE, Inc., Beaverton, OR (US)

( * ) Notice: Subject to any disclaimer, the term of this patent is extended or adjusted under 35 U.S.C. 154(b) by 170 days.

(21) Appl. No.: 17/844,957

(22) Filed: Jun. 21, 2022

(65) Prior Publication Data

US 2022/0400792 A1 Dec. 22, 2022

Related U.S. Application Data

(60) Provisional application No. 63/212,946, filed on Jun. 21, 2021.

(51) Int. Cl.
*A41D 19/015* (2006.01)
*A63B 71/08* (2006.01)

(52) U.S. Cl.
CPC ..... *A41D 19/01523* (2013.01); *A63B 71/081* (2013.01)

(58) Field of Classification Search
CPC ..... Y10S 2/03; A41D 19/01523; A63B 71/143; A63B 71/081; A63B 71/145
See application file for complete search history.

(56) References Cited

U.S. PATENT DOCUMENTS 2,275,206 A 3/1942 Sutherland
2,842,771 A * 7/1958 Foti ..... A41D 19/01529 976/DIG. 339

(Continued)

FOREIGN PATENT DOCUMENTS

WO 9211780 A1 7/1992
WO WO-9628056 A1 * 9/1996 ..... A42B 3/121

(Continued)

OTHER PUBLICATIONS

Banzai Kids Inflatable Mega Boxing Gloves, Red Blue, Amazon, amazon.com, ASIN: B00WORTWGA, Release date: Mar. 2, 2021, https://www.amazon.com/Banzai-Kids-Inflatable-Boxing-Gloves/dp/B00WORTWGA.

"Weldas COMFOflex Air Cushioned—Split Leather Premium Welding Gloves", Amazon, amazon.com, ASIN: B0792LWNYS Date First Available: Jan. 16, 2018, https://www.amazon.com/Weldas-COMFOflex-Air-Cushioned-Leather/dp/B0792LWNYS.

*Primary Examiner* — Patrick J. Lynch
(74) *Attorney, Agent, or Firm* — Banner & Witcoff, Ltd.

(57) ABSTRACT

Hand-receiving devices, such as gloves (e.g., sports gloves including baseball gloves, softball gloves, batting gloves, cricket gloves, golf gloves, America football gloves, weight-lifting gloves, exercise gloves, goalkeeper gloves (e.g., for soccer, hockey, field hockey, lacrosse, etc.), and the like) include an inflatable component, such as a fluid-filled bladder component. The fluid-filled bladder component may be structured and arranged within a glove base member to engage two or more digits of a wearer's hand (e.g., two or more of the thumb and/or fingers on one hand). Inflation of the bladder component may displace one or more layers of the glove base member (e.g., fabric layers) to adjust fit, help properly position the wearer's fingers and/or hand within the glove, help maintain the position of the wearer's fingers and/or hand within the glove and/or provide cushioning. Features of this technology also may be used to control stiffness and/or rigidity of the glove.

20 Claims, 9 Drawing Sheets

(56) References Cited

U.S. PATENT DOCUMENTS

| | | | | | |
|---|---|---|---|---|---|
| 2,881,445 | A | | 4/1959 | Vrana | |
| 3,008,214 | A | * | 11/1961 | Foster | D03D 1/02 428/167 |
| 4,168,063 | A | | 9/1979 | Rowland | |
| 4,183,156 | A | * | 1/1980 | Rudy | A43B 13/40 36/44 |
| 5,155,864 | A | | 10/1992 | Walker et al. | |
| 5,155,865 | A | | 10/1992 | Walker et al. | |
| 5,218,719 | A | | 6/1993 | Johnson | |
| 5,309,573 | A | | 5/1994 | Solar et al. | |
| 5,345,609 | A | | 9/1994 | Fabry et al. | |
| 5,423,088 | A | | 6/1995 | Walker et al. | |
| 5,427,577 | A | | 6/1995 | Picchietti et al. | |
| 5,771,490 | A | * | 6/1998 | Reynolds | F16F 9/0472 74/551.9 |
| 6,014,823 | A | * | 1/2000 | Lakic | B29D 35/12 36/71 |
| 6,202,213 | B1 | | 3/2001 | Georgick | |
| 6,308,331 | B1 | | 10/2001 | Robak | |
| 6,430,751 | B1 | | 8/2002 | Tourbier et al. | |
| 8,656,513 | B2 | | 2/2014 | Plocher | |
| 2008/0244801 | A1 | * | 10/2008 | Russo | A41B 11/00 2/311 |
| 2009/0158496 | A1 | | 6/2009 | Roeckl | |
| 2014/0245527 | A1 | * | 9/2014 | Douglas | A41D 13/0053 2/24 |
| 2018/0332924 | A1 | * | 11/2018 | Bailey | A43B 13/04 |
| 2020/0306591 | A1 | | 10/2020 | Billeaudeaux et al. | |

FOREIGN PATENT DOCUMENTS

| | | | |
|---|---|---|---|
| WO | 9720478 | A1 | 6/1997 |
| WO | 9828055 | A1 | 7/1998 |
| WO | 9966810 | A1 | 12/1999 |
| WO | 2008009945 | A1 | 1/2008 |
| WO | 2017075671 | A1 | 5/2017 |

* cited by examiner

GLOVES AND/OR OTHER HAND-RECEIVING DEVICES WITH INFLATABLE COMPONENTS

RELATED APPLICATION DATA

This application is a U.S. Non-Provisional Patent Application of and claims priority to U.S. Provisional Patent Appln. No. 63/212,946, filed Jun. 21, 2021 and entitled "Gloves and/or Other Hand-Receiving Devices with Inflatable Components." U.S. Provisional Patent Appln. No. 63/212,946 is entirely incorporated herein by reference.

FIELD OF THE INVENTION

The present technology relates to the field of gloves, such as sports gloves (e.g., baseball gloves, softball gloves, batting gloves, cricket gloves, golf gloves, America football gloves, weightlifting gloves, exercise gloves, goalkeeper gloves (e.g., for soccer, hockey, field hockey, lacrosse, etc.), etc.) and/or other types of hand-receiving devices. More specifically, aspects of the present technology pertain to gloves that include inflatable components, e.g., to improve fit and/or stability, to enhance cushioning, to control stiffness and/or rigidity, etc.

BACKGROUND

Conventional gloves, including sports gloves, typically have little in the way of size adjustment, particularly within the main body of the glove. Improper sizing may cause the glove to undesirably move on a user's hand under an applied force (e.g., contact with a ball or the ground, etc.). This may cause the user to mishandle a ball or other object and/or cause the glove to become dislodged from the wearer's hand.

Terminology

Some general terminology and information is provided that will assist in understanding various portions of this specification and the invention(s) as described herein.

This application and/or claims use the various adjectives, e.g., "first," "second," "third," and the like, to identify various components and/or features relating to this technology. These adjectives are used merely for convenience, e.g., to assist in maintaining a distinction between various components and/or features of a specific structure. Use of these adjectives should not be construed as requiring a specific order or arrangement of the components and/or features being discussed. Also, use of these specific adjectives in the specification for a specific structure does not carry over into the claims (e.g., a component or feature referred to as the "fourth" in the specification may correspond to any numerical adjective used for that component or feature in the claims). Any digit-engaging component or region may have "first," "second," and/or other component(s).

The term "width dimension" as used herein in conjunction with widths W1, W2, and W3 means a shortest, direct side-to-side dimension of the object.

SUMMARY

Hand-receiving devices, such as gloves (e.g., sports gloves including baseball gloves, softball gloves, batting gloves, cricket gloves, golf gloves, America football gloves, weightlifting gloves, exercise gloves, goalkeeper gloves (e.g., for soccer, hockey, field hockey, lacrosse, etc.), and the like), include an inflatable component, such as a fluid-filled bladder component. The fluid-filled bladder component may be structured and arranged within and/or with respect to a glove base member to engage two or more digits of a wearer's hand (e.g., two or more of the thumb and/or fingers on one hand). Inflation of the bladder component may displace one or more layers of the glove base member (e.g., fabric layers) to adjust or improve fit, to help properly position the wearer's fingers and/or hand within the glove, to help maintain the position of the wearer's fingers and/or hand within the glove, to improve stability, to enhance cushioning, and/or to control stiffness and rigidity, etc.

BRIEF DESCRIPTION OF THE DRAWINGS

The foregoing Summary, as well as the following Detailed Description, will be better understood when read in conjunction with the accompanying drawings in which like reference numerals refer to the same or similar elements in all of the various views in which that reference number appears.

Figure 1:
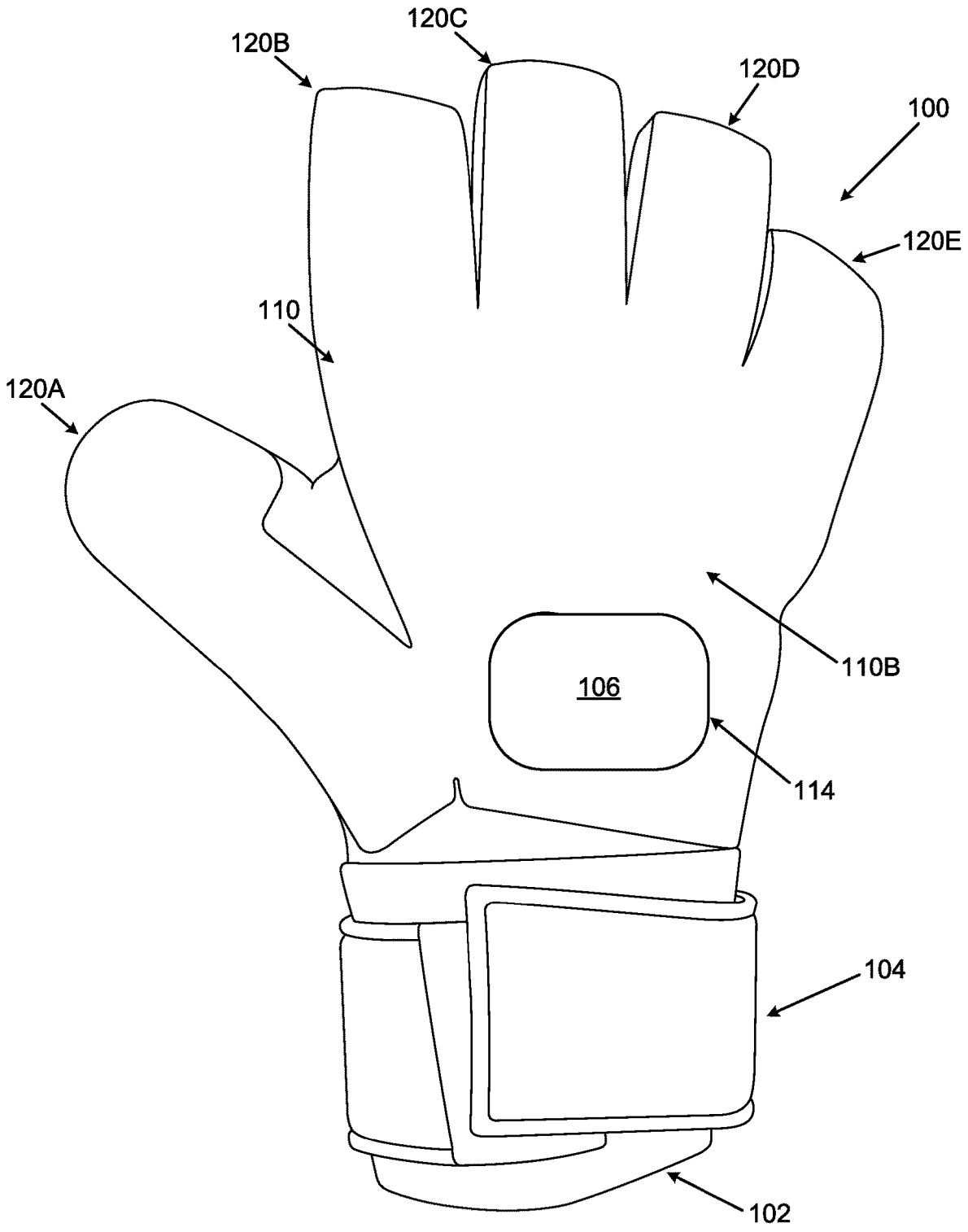
FIG. 1 illustrates an example glove base member in accordance with some examples of this technology.

The reader should understand that the attached drawings are not necessarily drawn to scale.

DETAILED DESCRIPTION

In the following description of various examples of gloves and hand-receiving device structures and components according to the present technology, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures and functions without departing from the scope of the present invention.

I. Description of Example Gloves and/or Other Hand-Receiving Devices According to this Technology Referring to the figures and following discussion, various gloves and/or other hand-receiving components and features thereof in accordance with aspects of the present technology are disclosed. Concepts disclosed with respect to these components and gloves may be applied to a wide range of glove styles and products, including, but not limited to: sports gloves (e.g., baseball gloves, softball gloves, batting gloves, cricket gloves, golf gloves, America football gloves, weightlifting gloves, exercise gloves, goalkeeper gloves (e.g., for soccer, hockey, field hockey, lacrosse, etc.), etc.) and/or other types of hand-receiving devices. In addition, concepts relating to the present technology may be applied to a wide range of non-athletic gloves, including work gloves, protective gloves, and dress gloves.

Some aspects of this technology relate to bladder systems (e.g., inflatable bladder components) that may be incorporated into glove products, e.g., of the various types described above. Such bladder systems may include a bladder component having a first wall and a second wall (e.g., one wall facing the back of the wearer's hand (and toward the front of the glove) when the glove is worn in use and the other wall facing away from the wearer's hand (and toward the back of the glove) when the glove is worn in use). Some examples of such bladder components include a first digit-engaging member including: (i) a first side fluid chamber defined between the first wall and the second wall, (ii) a second side fluid chamber defined between the first wall and the second wall, (iii) a first free end fluid chamber defined between the first wall and the second wall and connecting the first side fluid chamber and the second side fluid chamber, and (iv) a first space separating the first side fluid chamber and the second side fluid chamber. This first space may extend continuously from the first free end fluid chamber (e.g., to a first closed end) and substantially an entire longitudinal length of the first digit-engaging member. Such bladder components further may include a second digit-engaging member including: (i) a third side fluid chamber defined between the first wall and the second wall, (ii) a fourth side fluid chamber defined between the first wall and the second wall, (iii) a second free end fluid chamber defined between the first wall and the second wall and connecting the third side fluid chamber and the fourth side fluid chamber, and (iv) a second space separating the third side fluid chamber and the fourth side fluid chamber. This second space may extend continuously from the second free end fluid chamber (e.g., to a second closed end) and substantially an entire longitudinal length of the second digit-engaging member. Bladder components of this type may include additional digit-engaging members of the same general structures described above and/or of different structures, e.g., up to one digit-engaging member for each digit of a human hand (e.g., from two to five total digit-engaging members). The "spaces" described above may constitute physical gaps in the bladder component between the side fluid chambers and/or bonded areas between the side fluid chambers where the interior surfaces of the two walls are bonded together.

Additional aspects of this technology relate to bladder systems (e.g., inflatable bladder components) that may be incorporated into glove products and include a bladder component having a first wall and a second wall (e.g., one wall facing the back of the wearer's hand (and toward the front of the glove) when the glove is worn in use and the other wall facing away from the wearer's hand (and toward the back of the glove) when the glove is worn in use). Some examples of bladder components according to this aspect of the present technology include: (a) a base region; and (b) a first digit-engaging member including: (i) a first side fluid chamber defined between the first wall and the second wall, (ii) a second side fluid chamber defined between the first wall and the second wall, (iii) a first free end fluid chamber defined between the first wall and the second wall and connecting the first side fluid chamber and the second side fluid chamber, and (iv) a first bonded region where an interior surface of the first wall is bonded to an interior surface of the second wall, the first bonded region separating the first side fluid chamber and the second side fluid chamber. This first bonded region may extend continuously from the first free end fluid chamber to a first closed end. Additionally or alternatively, such bladder components may include a second digit-engaging member extending away from the base region, the second digit-engaging member including: (i) a third side fluid chamber defined between the first wall and the second wall, (ii) a fourth side fluid chamber defined between the first wall and the second wall, (iii) a second free end fluid chamber defined between the first wall and the second wall and connecting the third side fluid chamber and the fourth side fluid chamber, and (iv) a second bonded region where the interior surface of the first wall is bonded to the interior surface of the second wall, the second bonded region separating the third side fluid chamber and the fourth side fluid chamber. This second bonded region may extend continuously from the second free end fluid chamber to the base region. Bladder components of this type may include additional digit-engaging members of the same general structures described above and/or of different structures, e.g., up to one digit-engaging member for each digit of a human hand (e.g., from two to five total digit-engaging members).

Still additional aspects of this technology relate to bladder systems (e.g., inflatable bladder components) that may be incorporated into glove products and include a bladder component having a first wall and a second wall (e.g., one wall facing the back of the wearer's hand (and toward the front of the glove) when the glove is worn in use and the other wall facing away from the wearer's hand (and toward the back of the glove) when the glove is worn in use), wherein a fluid chamber is defined between the first wall and the second wall. Some examples of bladder systems according to this aspect of the present technology include: (i) an unbonded region where an interior surface of the first wall is unattached to an interior surface of the second wall, the unbonded region defining the fluid chamber, and (ii) a plurality of separated bonded regions where the interior surface of the first wall is attached to the interior surface of the second wall. The unbonded region of these examples of the present technology may define the fluid chamber as an outer perimeter fluid chamber that extends continuously to form at least: (i) a first digit-engaging region having a first side perimeter edge chamber and a second side perimeter edge chamber and (ii) a second digit-engaging region having a third side perimeter edge chamber and a fourth side perimeter edge chamber. A first bonded region of the plurality of separated bonded regions extends continuously along a length direction of the first digit-engaging region to separate the first side perimeter edge chamber from the second side perimeter edge chamber and to form a first knuckle-flexion region and a second knuckle-flexion region separated from the first knuckle-flexion region along the length direction of the first digit-engaging region. Similarly, a second bonded region of the plurality of separated bonded regions extends continuously along a length direction of the second digit-engaging region to separate the third side perimeter edge chamber from the fourth side perimeter edge chamber and to form a third knuckle-flexion region and a fourth knuckle-flexion region separated from the third knuckle-flexion region along the length direction of the second digit-engaging region. Bladder systems of this type may include additional bonded region(s) and/or unbonded region(s), e.g. to provide additional digit-engaging regions and/or knuckle-flexion regions, e.g., of the same general structures described above or of different structures, e.g., up to one digit-engaging region for each digit of a human hand (e.g., from two to five total digit-engaging regions).

Any of the aspects, bladder systems, and/or bladder components described above may include additional fluid control components, such as a pump to inflate the fluid chamber (e.g., a manual pump, a battery operated pump, etc.) and/or a release valve to release fluid from the fluid chamber.

Still additional aspects of this technology relate to methods of making bladder systems, gloves, and/or other hand-receiving components, e.g., of the types and having the structures described above (and described in more detail below). In such methods, the bladder component(s) may be made by applying heat and pressure to two facing thermoplastic components (e.g., two or more separate sheet components, a folded sheet component, etc.) to form the bonded region(s) and/or seams in the bladder components. Area of the two facing thermoplastic components where heat and pressure are not applied may form and correspond to the fluid-chamber and/or unbonded areas. Once formed, the bladder system and/or component may be engaged with a glove base member to form a glove structure. The glove base member may be engaged with the bladder system and/or component in any desired manner, for example, using one or more of: by fuse bonding (e.g., applying heat and pressure to join the bladder to one or more components of a glove base structure); by adhesives or cements; by sewing techniques; by mechanical fasteners; etc. Additional aspects of this technology relate to gloves and/or hand-receiving devices, e.g., including the structure(s) and/or made by the method(s) described above. Still additional aspects of this technology relate to use of the gloves, e.g., while engaging in athletic activities, including one or more of: placing the glove on a wearer's hand, inflating the bladder component (e.g., using the pump), deflating the bladder component (e.g., using the release valve), altering fluid pressure in the bladder component, and/or removing the glove from the wearer's hand.

Given the above background and general description of aspects and examples of this technology, a more detailed description of specific examples of gloves, other hand-receiving components, and/or component parts thereof in accordance with at least some examples of this technology and this invention follows.

II. Detailed Description of Specific Example Gloves and/or Other Hand-Receiving Devices According to this Technology FIG. 1 illustrates a glove base member 100 that may be used in some examples of this technology. The glove base member 100 includes an interior (or hand-receiving) chamber 106 (not shown in FIG. 1, but see FIGS. 4B-6B) for receiving at least a portion of a wearer's hand. The interior chamber 106 is accessible via wrist opening 102. In this illustrated example, the wrist opening 102 includes a size adjustment and/or tightening mechanism 104 for securing the glove base member 100 to a wearer's hand and/or arm. The illustrated size adjustment and/or tightening mechanism 104 in this example includes a hook-and-loop fastener included on a strap that at least partially wraps around the wearer's wrist and/or arm. The hook-and-loop fastener parts secure to one another to hold the glove base member 100 in place on the wearer's wrist and/or arm. Additionally or alternatively, one or more other fasteners and/or tightening structures may be used, if desired, including buttons, snaps, buckles, laces, elastic band(s), etc.

The glove base member 100 of this example includes a soccer (or global football) goalkeeper glove having a rear component 110 and a front component 112 (not shown in FIG. 1, but see FIGS. 4B-6B). The rear component 110 and front component 112 may be made from any desired material(s), such as fabrics, leather, polymeric materials, etc., including materials as are conventionally known and used in the glove art. Additionally, each of rear component 110 and front component 112 may be made from any desired number and/or arrangement of component parts, including numbers of parts and/or arrangements of parts as are known and used in the glove art (e.g., front and rear thumb and/or finger components, gussets, reinforcements, padding, etc.). Additionally or alternatively, if desired, one or more rear component 110 parts may extend around to form at least some portion of the front component 112 and/or one or more front component 112 parts may extend around to form at least some portion of the rear component 110. The front and rear of the glove base member 100 also may be made as a single part. Thus, a wide range of structures, constructions, and/or parts may be used in the glove base member 100 without departing from this technology, including structures, constructions, and/or parts conventionally known and used in the glove art. The rear component 110 shown in FIG. 1 includes at least one rear opening 114, the structure and use of which will be described in more detail below.

Figure 4A:
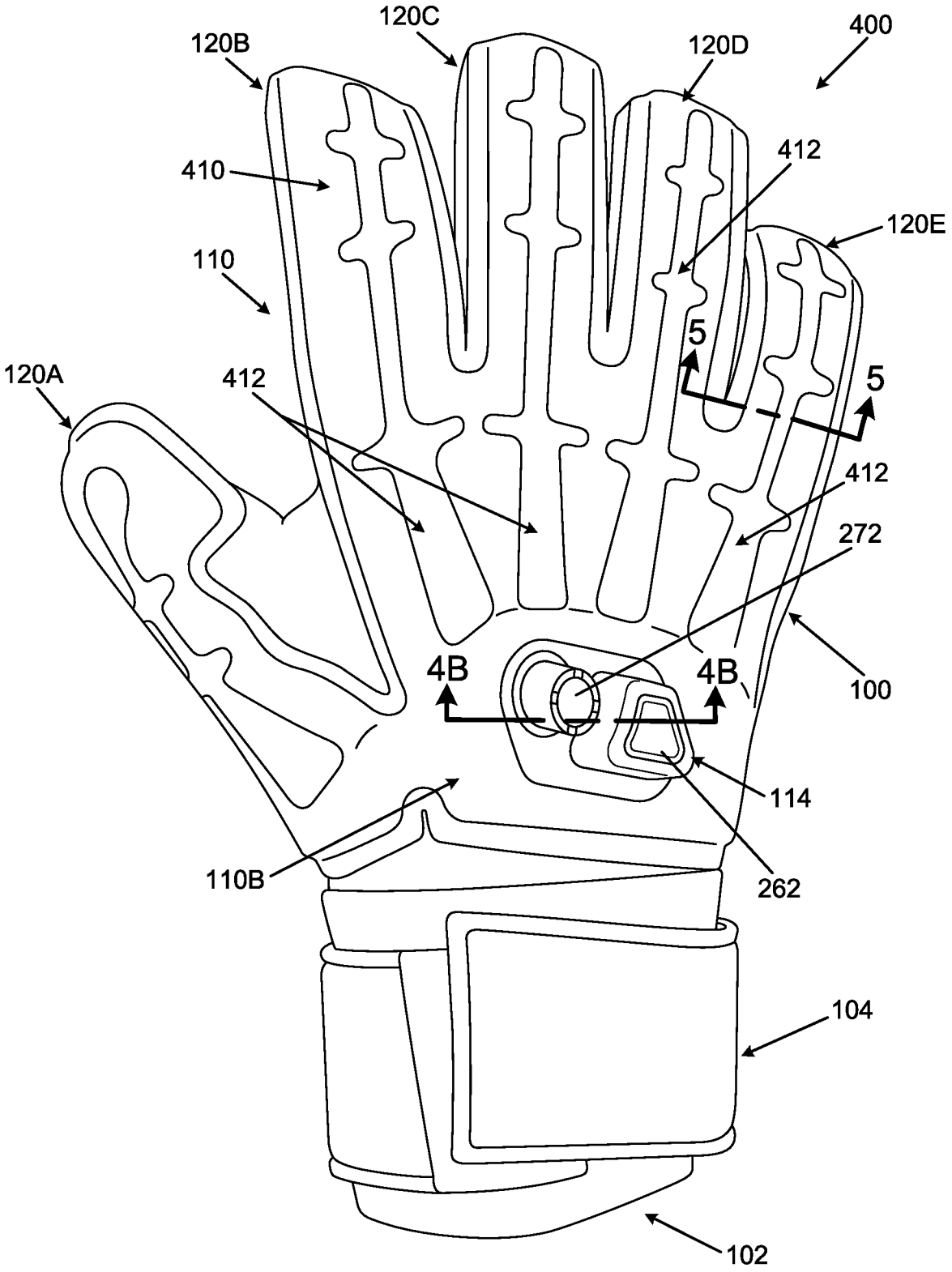
FIGS. 4A-4C illustrate examples and/or features of gloves including bladder systems in accordance with some examples of this technology.

While other structures are possible in accordance with some examples of this technology, the glove base member 100 of this example includes a plurality of digit-engaging regions 120 (also referred to herein as "digit-receiving compartments"). As some more specific examples of digit-engaging regions 120, glove base member 100 may include two or more of (a) a thumb-engaging region 120A and/or (b) one or more finger-engaging regions (four finger-engaging regions 120B, 120C, 120D, and 120E shown in FIG. 1). The glove base member 100 further may include one or more rear base hand components (110B) and/or one or more palm covering components (112B, not shown in FIG. 1, but see FIGS. 4B and 4C) from which the digit-engaging region(s) 120 extend. The rear base hand component(s) 110B and/or the palm covering component(s) 112B extend to support the size adjustment and/or tightening mechanism 104 and/or to define the hand-receiving opening 102 in this example. In this illustrated example, a rear opening 114 is defined through the rear base hand component(s) 110B. As shown in FIGS. 1 and 4A, open space exterior to the glove base member 100 separates the individual digit-receiving compartments 120A-120E from one another, and the outer edges of the individual digit-receiving compartments 120A-120E are unattached to one another.

Figure 2A:
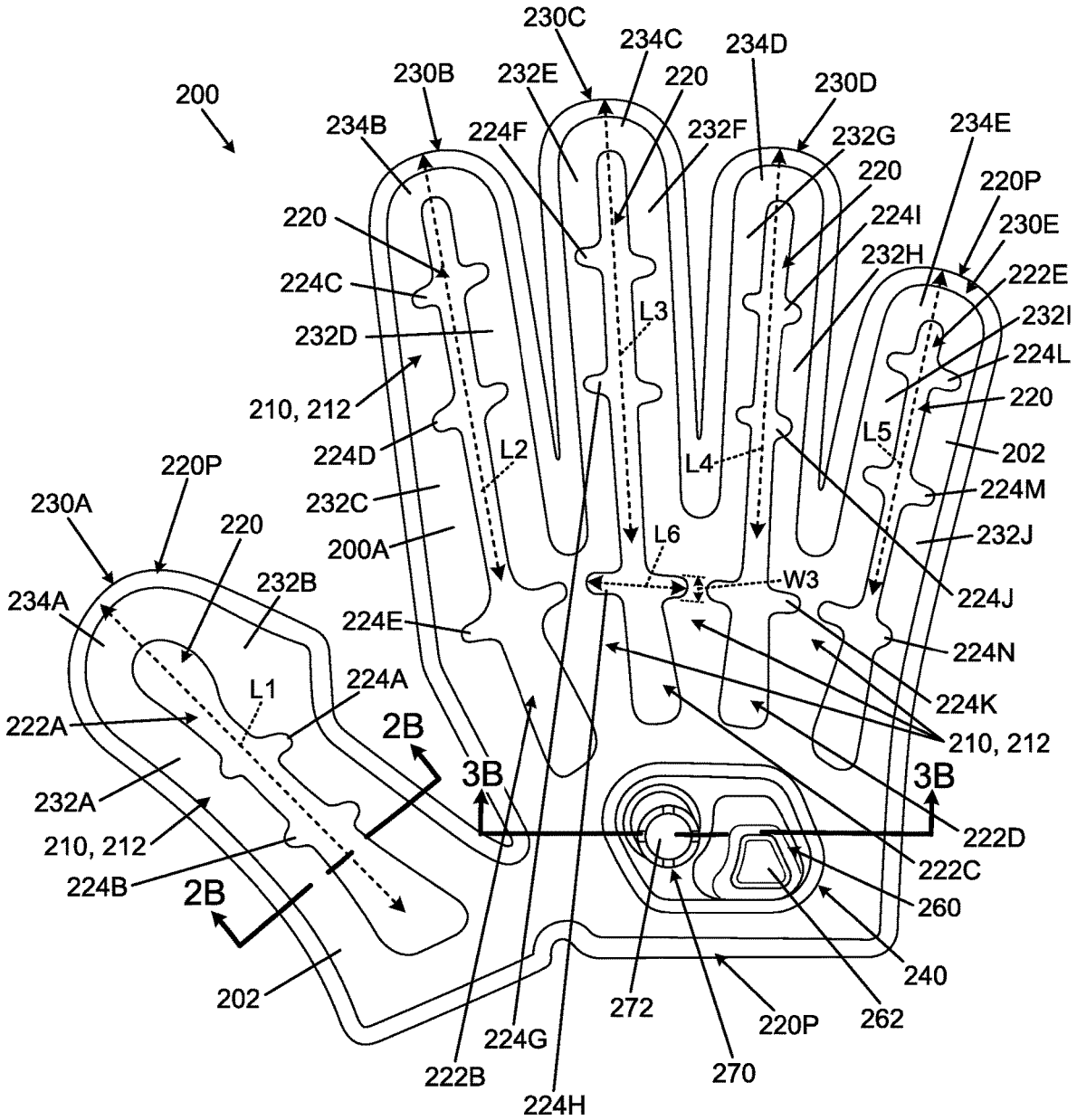
FIGS. 2A-2D illustrate examples and/or features of bladder systems and their digit-engaging regions in accordance with some examples of this technology.
Figure 2B:
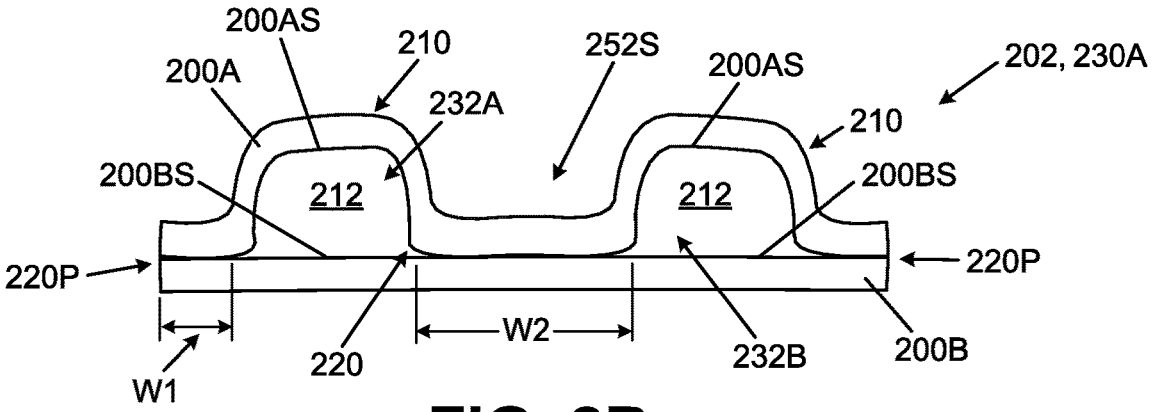
Figure 2C:
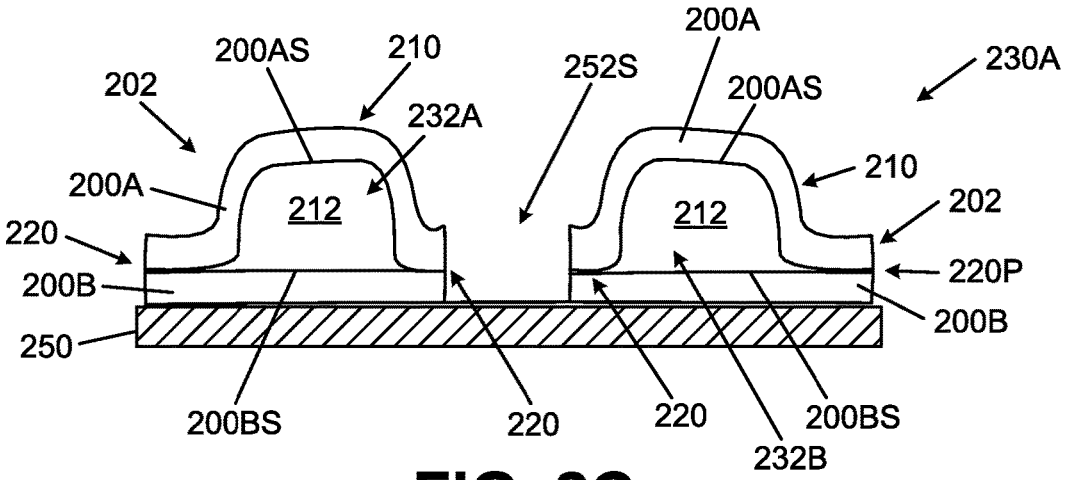
Figure 2D:
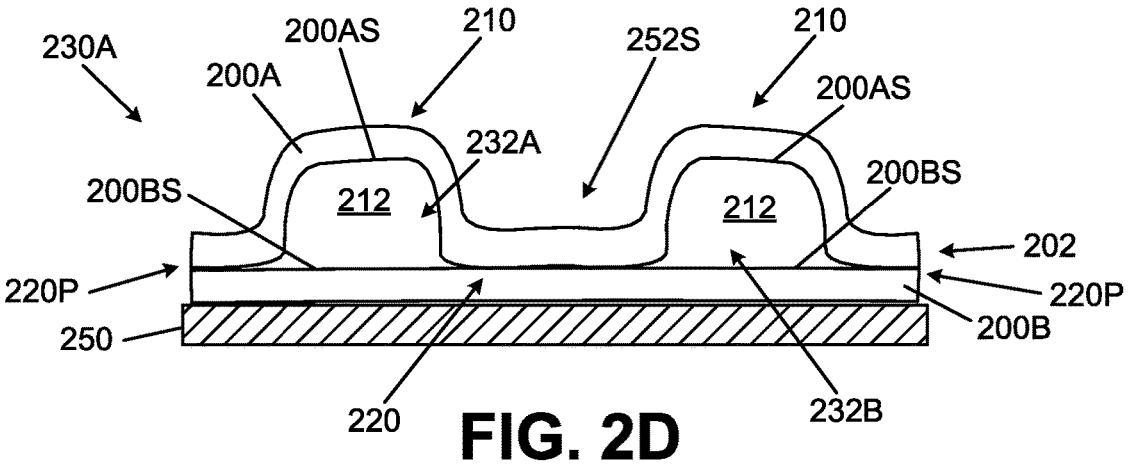

FIGS. 2A-2D illustrate various features and examples of an inflation system (e.g., a bladder system 200) that may be included in glove products in accordance with some examples of this technology. FIG. 2A shows a rear view of the bladder system 200, and FIGS. 2B-2D are cross-sectional views of various example bladder component 202 structures taken through digit-engaging region 230A along line 2B-2B of FIG. 2A. Cross-sectional views through the other digit-engaging regions 230B-230E, however, may have the same or similar structures to those shown in FIGS. 2B-2D. The bladder system 200 of this example may be engaged with a glove base member 100, e.g., of the types described above in conjunction with FIG. 1. This engagement may take place in any desired manner, including via one or more of sewing, adhesives, fuse bonding, mechanical fasteners, etc.

In this illustrated example, the bladder system 200 includes a bladder component 202 having a first wall 200A and a second wall 200B, wherein a fluid chamber 212 is defined at some locations between the first wall 200A and the second wall 200B. The first wall 200A and the second wall 200B may be formed from a thermoplastic material, including thermoplastic materials of the type known and used for fluid-tight bladders in the footwear arts. Each of the first wall 200A and/or the second wall 200B may be formed from one or more sheets of thermoplastic material. Alternatively, if desired, a single sheet (e.g., folded over) may form all or at least some portion(s) of first wall 200A and second wall 200B. The first wall 200A and the second wall 200B may be fixed together at least at some locations, e.g., by bonding. This may include, for example, use of heat and pressure; welding techniques (e.g., RF welding, ultrasonic welding, etc.); cements or adhesives; etc., as are known and used in the footwear bladder arts to form one or more sealed, fluid-tight chambers and/or to shape one or more bladder components. Area(s) where the two facing walls 200A, 200B are not bonded together (e.g., where heat and pressure and/or welding techniques are not applied) may correspond to the fluid-chamber and/or unbonded areas. Controlling the size and shape of the bonded and unbonded areas of a bladder component 202 (e.g., the location(s) of seams and/or bonds) also can control the shape of the bladder component 202 when inflated.

As shown in FIGS. 2A-2D, the bladder component 202 of these examples includes at least one unbonded region 210 where an interior surface 200AS of the first wall 200A is unattached to an interior surface 200BS of the second wall 200B. The unbonded region(s) 210 define a fluid chamber 212 within the bladder component 202, and these walls 200A and 200B are sufficiently flexible to separate from one another when the bladder component 202 is inflated. While other options are possible, FIG. 2A shows the inflatable fluid chamber 212 as a continuous (uninterrupted) chamber that extends around an outer perimeter of the bladder component 202. The bladder component 202 further includes a plurality of separated bonded regions 220 where the interior surface 200AS of the first wall 200 is attached to the interior surface 200BS of the second wall 200B. The bonded regions 220 may form sealed lines or areas, e.g., fluid does not move through the bonded regions 220. Additionally, in this illustrated example, the bonded regions 220 include an outermost perimeter bond 220P around the outer perimeter edge of the bladder system 200 and defining one side of the fluid chamber 212. This outermost perimeter bond 220P may have a width dimension W1 (see FIG. 2B) of the sealed bond over at least 50% of its overall length around the perimeter in a range between 1.5 mm and 10 mm, and in some examples, at least 50% of the overall length around the perimeter will have a width W1 within a range between 2 mm and 8 mm or even between 3 mm and 6 mm. The width W1 of outermost perimeter bound 220P may be constant or varied over the course of the perimeter where it is located. Any of these width dimension ranges for W1 may be present over at least 75%, at least 80%, or even at least 85% of the overall length of the outermost perimeter bond 220P (including up to 100%). Additionally or alternatively, the outermost perimeter bond 220P may be present over at least 50%, and in some examples at least 75%, at least 80%, or even at least 85% of the outer perimeter of the bladder component 202 (including up to 100%).

In the example bladder system 200 shown in FIG. 2A, the unbonded region 210 defines the fluid chamber 212 as an outer perimeter fluid chamber that extends continuously to form at least (i) a first digit-engaging region (e.g., 230A) having a first side perimeter edge chamber (e.g., 232A) and a second side perimeter edge chamber (e.g., 232B) and (ii) a second digit-engaging region (e.g., 230B) having a third side perimeter edge chamber (e.g., 232C) and a fourth side perimeter edge chamber (e.g., 232D). In the illustrated example of FIG. 2A, the outer perimeter fluid chamber 212 defined by the unbonded region 210 further extends continuously to form (iii) a third digit-engaging region (e.g., 230C) having a fifth side perimeter edge chamber (e.g., 232E) and a sixth side perimeter edge chamber (e.g., 232F), (iv) a fourth digit-engaging region (e.g., 230D) having a seventh side perimeter edge chamber (e.g., 232G) and an eighth side perimeter edge chamber (e.g., 232H), and (v) a fifth digit-engaging region (e.g., 230E) having a ninth side perimeter edge chamber (e.g., 232I) and a tenth side perimeter edge chamber (e.g., 232J). The side perimeter edge chambers 232A-232J of the fluid chamber 212 also are referred to herein as "side fluid chambers."

The plurality of bonded regions 220 help define the fluid chamber 212 as an outer perimeter fluid chamber, help distinguish the fluid chamber 212 regions or parts, and help define the digit-engaging regions 230A-230E. As shown in FIG. 2A, a first bonded region (e.g., 222A) of the plurality of separated bonded regions 220 extends continuously in a direction along a length direction L1 of the first digit-engaging region 230A to separate the first side perimeter edge chamber 232A from the second side perimeter edge chamber 232B. The first bonded region 222A of this example further forms a first knuckle-flexion region 224A and a second knuckle-flexion region 224B separated from the first knuckle-flexion region 224A along the longitudinal length direction L1 of the first digit-engaging region 230A. The first knuckle-flexion region 224A and the second knuckle-flexion region 224B of this example are widened portions of the bonded region 222A that extend across the length direction L1 at areas of the first digit-engaging region 230A that correspond to the locations of two of a wearer's knuckles or joints on the digit.

Also, as shown in FIG. 2A, in this illustrated example, the plurality of separated bonded regions 220 further includes a second bonded region (e.g., 222B) that extends continuously in a direction along a length direction L2 of the second digit-engaging region 230B to separate the third side perimeter edge chamber 232C from the fourth side perimeter edge chamber 232D. The second bonded region 222B of this example further forms a third knuckle-flexion region 224C, a fourth knuckle-flexion region 224D separated from the third knuckle-flexion region 224C along the longitudinal length direction L2 of the second digit-engaging region 230B, and a fifth knuckle-flexion region 224E separated from the third knuckle-flexion region 224C and the fourth knuckle-flexion region 224D along the longitudinal length direction L2 of the second digit-engaging region 230B. The third knuckle-flexion region 224C, the fourth knuckle-flexion region 224D, and the fifth knuckle-flexion region 224E of this example are widened portions of the bonded region 222B that extend across the length direction L2 at areas of the second digit-engaging region 230B that correspond to the locations of three of a wearer's knuckles or joints on the digit.

The third digit-engaging region 230C of the example bladder system 200 shown in FIG. 2A also includes a bonded region (e.g., a third bonded region 222C) extending continuously in a direction along a length direction L3 of the third digit-engaging region 230C. This third bonded region 222C separates the fifth side perimeter edge chamber 232E of the fluid chamber 212 from the sixth side perimeter edge chamber 232F. The third bonded region 222C of this example further forms a sixth knuckle-flexion region 224F, a seventh knuckle-flexion region 224G separated from the sixth knuckle-flexion region 224F along the longitudinal length direction L3 of the third digit-engaging region 230C, and an eighth knuckle-flexion region 224H separated from the sixth knuckle-flexion region 224F and the seventh knuckle-flexion region 224G along the longitudinal length direction L3. The sixth knuckle-flexion region 224F, the seventh knuckle-flexion region 224G, and the eighth knuckle-flexion region 224H of this example are widened portions of the third bonded region 222C that extend across the length direction L3 at areas of the third digit-engaging region 230C that correspond to the locations of three of a wearer's knuckles or joints on the digit.

The example bladder system 200 of FIG. 2A further includes a fourth digit-engaging region 230D with a bonded region (e.g., a fourth bonded region 222D). The fourth bonded region 222D extends continuously in a direction along a longitudinal length direction L4 of the fourth digit-engaging region 230D and separates the seventh side perimeter edge chamber 232G of the fluid chamber 212 from the eighth side perimeter edge chamber 232H. The fourth bonded region 222D of this example further forms a ninth knuckle-flexion region 224I, a tenth knuckle-flexion region 224J separated from the ninth knuckle-flexion region 224I along the longitudinal length direction L4 of the fourth digit-engaging region 230D, and an eleventh knuckle-flexion region 224K separated from the ninth knuckle-flexion region 224I and the tenth knuckle-flexion region 224J along the longitudinal length direction L4. The ninth knuckle-flexion region 224I, the tenth knuckle-flexion region 224J, and the eleventh knuckle-flexion region 224K of this example are widened portions of the fourth bonded region 222D that extend across the length direction L4 at areas of the fourth digit-engaging region 230D that correspond to the locations of three of a wearer's knuckles or joints on the digit.

The fifth digit-engaging region 230E of the example bladder system 200 shown in FIG. 2A includes a fifth bonded region (e.g., 222E) extending continuously in a direction along a length direction L5 of the fifth digit-engaging region 230E. This fifth bonded region 222E separates the ninth side perimeter edge chamber 232I of the fluid chamber 212 from the tenth side perimeter edge chamber 232J. The fifth bonded region 222E further forms a twelfth knuckle-flexion region 224L, a thirteenth knuckle-flexion region 224M separated from the twelfth knuckle-flexion region 224L along the longitudinal length direction L5 of the fifth digit-engaging region 230E, and a fourteenth knuckle-flexion region 224N separated from the twelfth knuckle-flexion region 224L and the thirteenth knuckle-flexion region 224M along the longitudinal length direction L5. The twelfth knuckle-flexion region 224L, the thirteenth knuckle-flexion region 224M, and the fourteenth knuckle-flexion region 224N of this example are widened portions of the fifth bonded region 222E that extend across the length direction L5 at areas of the fifth digit-engaging region 230E that correspond to the locations of three of a wearer's knuckles or joints on the digit.

While FIG. 2A shows a bladder system 200 with five total digit-engaging regions 230A-230E, bladder systems 200 according to some examples of this technology may have any desired number (e.g., 2, 3, 4, or 5) of digit-engaging regions 230A-230E. Additionally or alternatively, bladder systems 200 according to some examples of this technology may include two or more digit-engaging regions 230A-230E with any desired number of knuckle-flexion regions (e.g., from 0 to 3) on each digit-engaging region 230A-230E. Further additionally or alternatively, the bonded region(s) 220 included in the digit-engaging region(s) 230A-230E may extend continuously in the longitudinal length dimension and/or direction of the digit-engaging region 230A-230E (e.g., the directions L1-L5 shown in FIG. 2A) for at least 40 mm, and in some examples for at least one or more digit-engaging region 230A-230E, at least 60 mm, at least 80 mm, or even at least 100 mm.

In at least some examples of this technology, the bonded regions 222A-222E within the digit-engaging regions 230A-230E, respectively, will have a width dimension W2 (see FIG. 2B) of the sealed bond over at least 75% of its overall length in a range between 1.5 mm and 20 mm, and in some examples, at least 75% of the overall length will have a width W2 within a range between 2 mm and 15 mm, between 2.5 mm and 12 mm, or even between 3 mm and 8 mm. The width W2 of the bonded region(s) 222A-222E may be constant or varied over its length. Additionally or alternatively, in at least some examples of this technology, the bonded regions 222A-222E within the digit-engaging regions 230A-230E, respectively, that form the knuckle-flexion regions 224A-224N will have a width dimension W3 (see FIG. 2A) of the sealed bond in a range between 1.5 mm and 15 mm, and in some examples, a width W3 within a range between 2 mm and 12 mm, between 2.5 mm and 10 mm, or even between 3 mm and 8 mm. The width W3 of the knuckle-flexion regions 224A-224N may be constant or varied over the side-to-side direction L6 of the knuckle-flexion regions 224A-224N. Each bonded region 222A-222E may extend continuously within its respective digit-engaging region 230A-230E to form the length(s) L1-L5 and corresponding knuckle-flexion region(s) 224A-224N for that digit-engaging region 230A-230E.

The fluid chamber 212 of this illustrated example bladder system 200 is a continuous fluid chamber that extends to form the first through tenth side perimeter edge chambers 232A-232J of the first through fifth digit-engaging regions 230A-230E. In the illustrated example, each of the first through fifth digit-engaging regions 230A-230E includes a free end fluid chamber to connect the side perimeter edge chambers of the fluid chamber 212 for that digit-engaging region. More specifically, as shown in FIG. 2A, fluid chamber 212 includes: (a) a first free end fluid chamber 234A that connects the first side perimeter edge chamber 232A and the second side perimeter edge chamber 232B of the fluid chamber 212 forming the first digit-engaging region 230A; (b) a second free end fluid chamber 234B that connects the third side perimeter edge chamber 232C and the fourth side perimeter edge chamber 232D of the fluid chamber 212 forming the second digit-engaging region 230B; (c) a third free end fluid chamber 234C that connects the fifth side perimeter edge chamber 232E and the sixth side perimeter edge chamber 232F of the fluid chamber 212 forming the third digit-engaging region 230C; (d) a fourth free end fluid chamber 234D that connects the seventh side perimeter edge chamber 232G and the eighth side perimeter edge chamber 232H of the fluid chamber 212 forming the fourth digit-engaging region 230D; and (e) a fifth free end fluid chamber 234E that connects the ninth side perimeter edge chamber 232I and the tenth side perimeter edge chamber 232J of the fluid chamber 212 forming the fifth digit-engaging region 230E.

FIG. 2A further illustrates that at least some of the first through fifth digit-engaging regions 230A-230E extend from or meet at a base region 240. The base region 240 of this example includes a sealed or bonded region. The first through fifth bonded regions 222A-222E included as part of the first through fifth digit-engaging regions 230A-230E, respectively, may terminate at closed ends, e.g., located at, within, or proximate to the base region 240. Also, the first through fifth bonded regions 222A-222E included as part of the first through fifth digit-engaging regions 230A-230E, respectively, extend continuously substantially an entire longitudinal length of the respective digit-engaging region 230A-230E in which it is contained. The term "substantially an entire longitudinal length" as used herein in this context means that the bonded region or space separating side perimeter edge chambers 232A-232J (or side fluid chambers) of the fluid chamber 212 from one another in a digit-engaging region 230A-230E extends continuously in the longitudinal length direction (in the directions of L1 to L5) for at least 75% of an entire longitudinal length dimension of the digit-engaging region 230A-230E in which it is contained. The longitudinal length dimension of a digit-engaging region is defined as the length dimension (a) from the outermost tip of the digit-engaging region 230A-230E to (b) a location of the bladder system 200 where that separate digit-engaging region 230A-230E is no longer discernible (e.g., where separate finger portions meet a base portion 240 or otherwise end). Additionally or alternatively, in some examples, one or more of the first through fifth bonded regions 222A-222E will extend continuously: (a) from an interior edge of the respective free end fluid chamber 234A-234E, (b) to form the separated knuckle-flexion regions (e.g., at least two longitudinally spaced knuckle-flexion regions), and (c) to a closed end, e.g., located at, within, or proximate to the base region 240. As shown in FIG. 2A, the bonded regions 222A-222E may extend beyond the location of the proximal-most knuckle-flexion region 224B, 224E, 224H, 224K, 224N.

Many different structural variations of digit-engaging regions 230A-230E and/or bladder components 202 may be provided in accordance with this technology. FIG. 2B illustrates the bladder component 202 as including just the bonded wall members 200A, 200B, and the bonded region 220 separates (and forms a space 252S between) the perimeter side edge chambers 232A and 232B of the fluid chamber 212. In FIG. 2C, the bladder component 202 is attached to a support component 250, e.g., made of fabric, plastic (e.g., a thermoplastic), etc., to support the bladder component 202. The support component 250, which may be made from one or more parts, may be engaged with the bladder component 202 in any desirable manner, e.g., including via one or more of fuse bonding (using heat and pressure without an adhesive), an adhesive, mechanical connector(s), sewing, etc. Rather than a bonded region 220 bridging the space 252S between the perimeter side edge chambers 232A and 232B of the fluid chamber 212, the example of FIG. 2C shows an open space bridged only by the support component 250. In this structure of FIG. 2C, the support component 250 is exposed in the digit-engaging region 230A in the area between the perimeter side edge chambers 232A and 232B of the fluid chamber 212. The example digit-engaging region 230A of FIG. 2D includes both the support component 250 and a bonded region 220 bridging the space 252S between the perimeter side edge chambers 232A and 232B of the fluid chamber 212. Thus, in the structure of FIG. 2D, the support component 250 is not exposed in the digit-engaging region 230A in the area between the perimeter side edge chambers 232A and 232B of the fluid chamber 212. While FIGS. 2B-2D include reference numbers relating to features of the first digit-engaging region 230A, any of the same or similar structures and variations could be used in any of the digit-engaging regions 230A-230E.

Figure 3A:
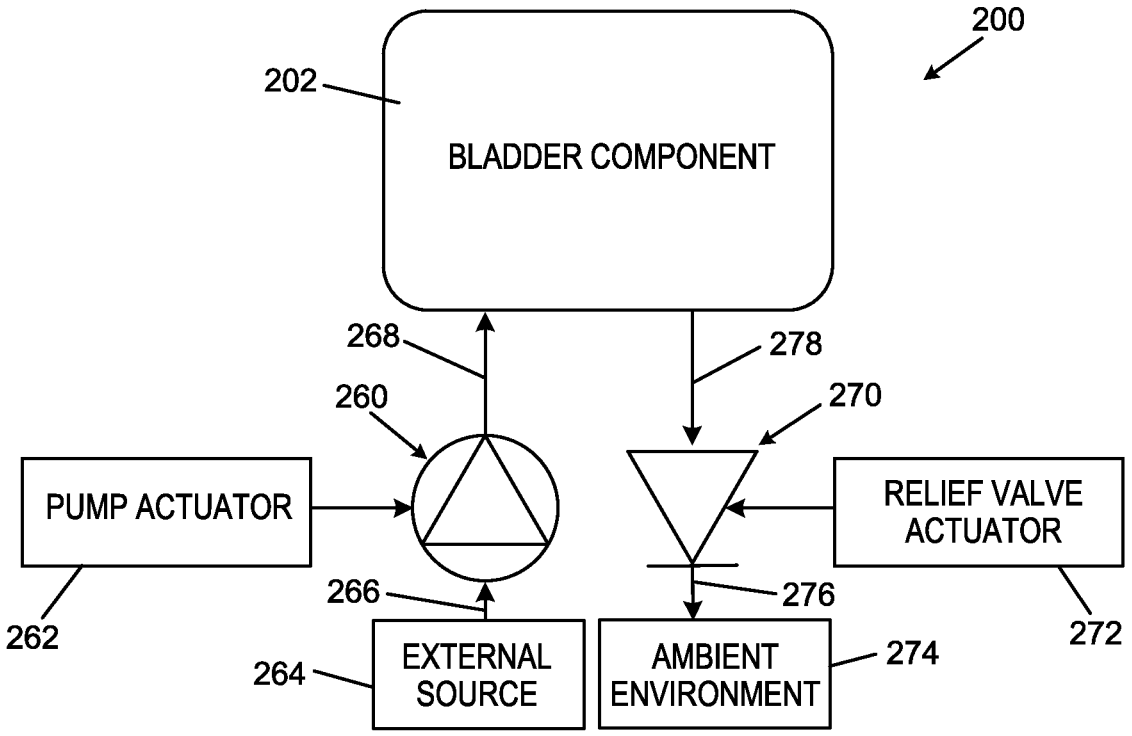
FIGS. 3A-3C illustrate examples and/or features of fluid systems that may be incorporated into glove products in accordance with at least some examples of this technology.
Figure 3B:
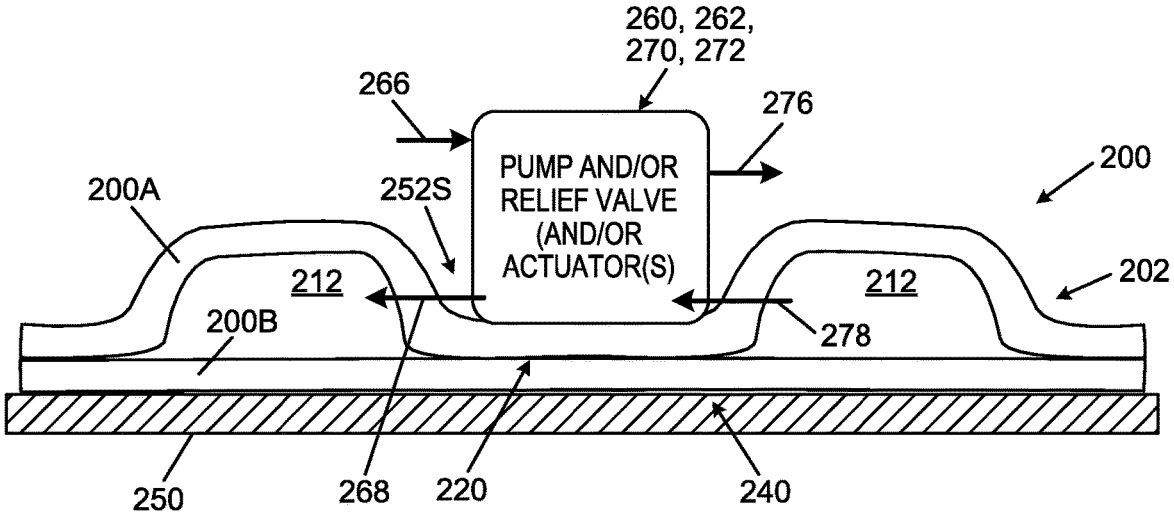
Figure 3C:
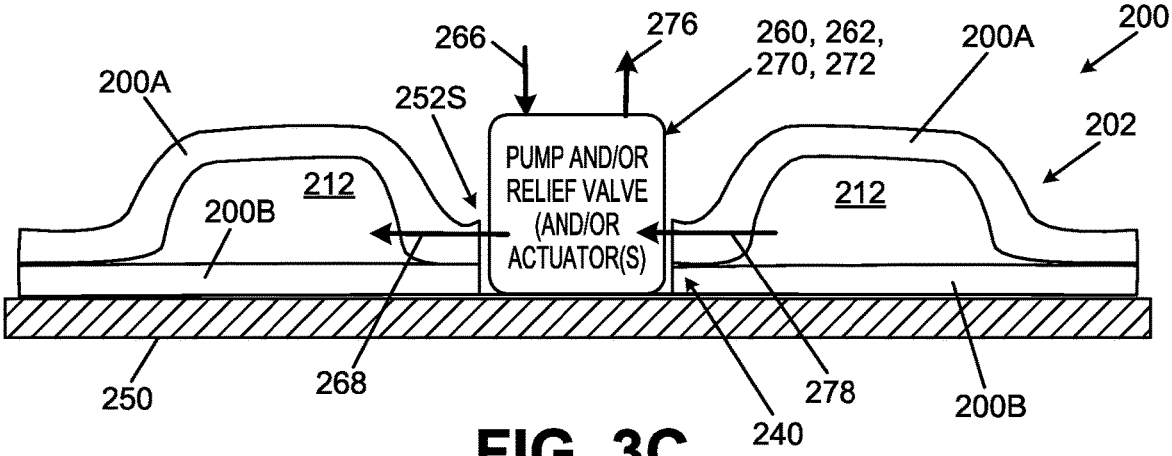

FIGS. 2A and 3A-3C show additional potential features of bladder systems 200 in accordance with at least some examples of this technology. FIG. 2A shows a rear plan view of an example bladder system 200, FIG. 3A shows a schematic view of fluid control components (e.g., fluid moving components) in accordance with some examples of this technology, and FIGS. 3B and 3C show cross-sectional views taken along line 3B-3B in FIG. 2A. As shown in these figures, the base region 240 of the bladder system 200 of this example is equipped with a pump 260 for introducing fluid into the bladder system 200 and bladder component 202 (into fluid chamber 212). The pump 260 may comprise a compressible bulb type pump, a manually operated pump, a battery operated pump, etc. In this illustrated example, user interaction with a pump actuator 262 draws fluid (e.g., air) in from an external source 264 (e.g., the ambient environment) via inlet 266 and moves the fluid into the bladder component 202 (via fluid line 268). Additionally, the base region 240 of this example is equipped with a pressure relief valve 270 for removing fluid from the bladder system 200 and bladder component 202 (from fluid chamber 212). The pressure relief valve 270 may comprise a push-button valve, a one-way valve, or other type of pressure release valve. In this illustrated example, user interaction with a pressure relief valve actuator 272 expels fluid (e.g., air) from the bladder component 202 via fluid line 278 into an external environment (e.g., the ambient environment 274) via outlet 276.

FIGS. 3B and 3C illustrate two examples of the manner in which the fluid control components (e.g., a pump 260, its components, a relief valve 270 and/or its components) may be engaged with the overall bladder system 200. As shown in FIG. 3B, the base region 240 of the bladder system 200 comprises a bonded region 220 (e.g., a sealed region) between the first sheet 200A and the second sheet 200B of the bladder component 202. The fluid control component(s) (e.g., 260, 262, 270, 272) may be mounted directly to one of the sheets (sheet 200A, in this illustrated example), e.g., by cements or adhesives, by fusing techniques, by mechanical connectors, etc. In the example of FIG. 3C, the base region 240 of the bladder system 200 comprises a space between two or more separated portions of the fluid chamber 212. In this instance, the fluid control component(s) (e.g., 260, 262, 270, 272) may be mounted on a base component 250, e.g., to which the sheet(s) 200A, 200B are fixed at areas outside the space 252S. The fluid control component(s) may be engaged with the base component 250 in any desired manner, e.g., by cements or adhesives, by fusing techniques, by mechanical connectors, etc. Further, while FIGS. 2A, 3B, and 3C show the fluid control components (e.g., 260, 262, 270, 272) generally located together and in close proximity to one another, other more spaced apart mounting options for these components are possible without departing from this technology, and any desired mounting locations and/or combination and/or separation of components may be utilized.

Figure 4B:
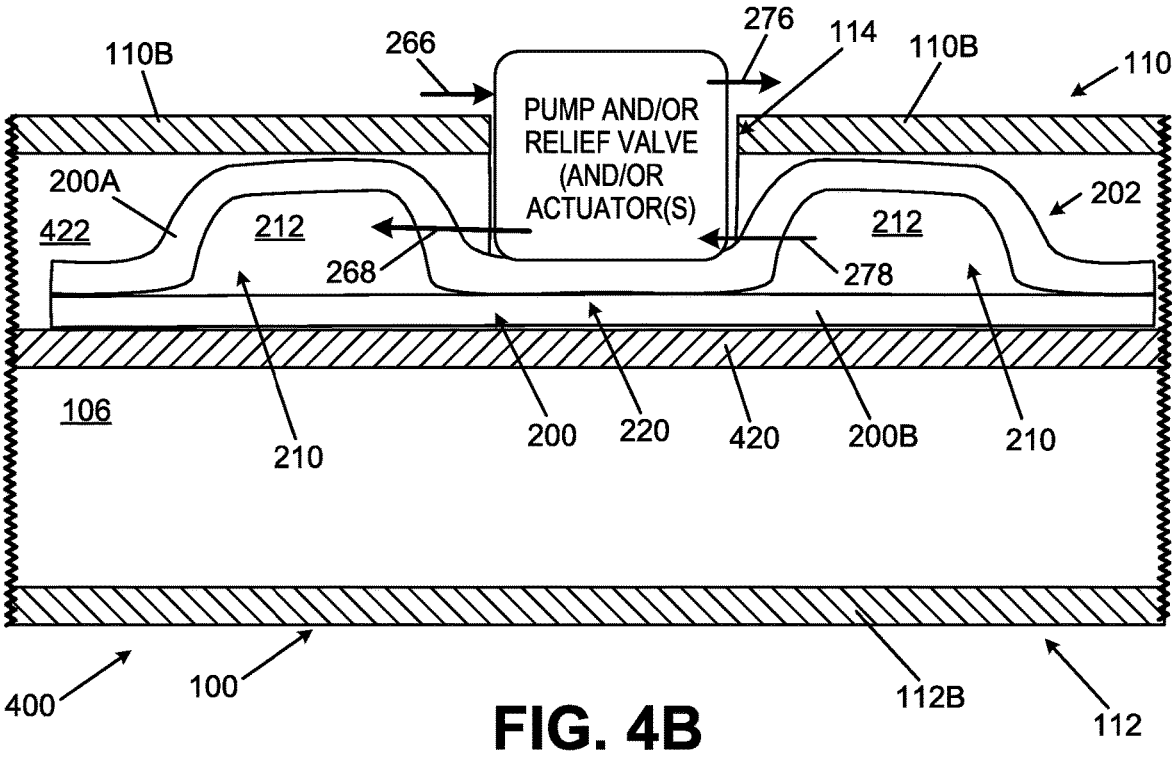
Figure 4C:
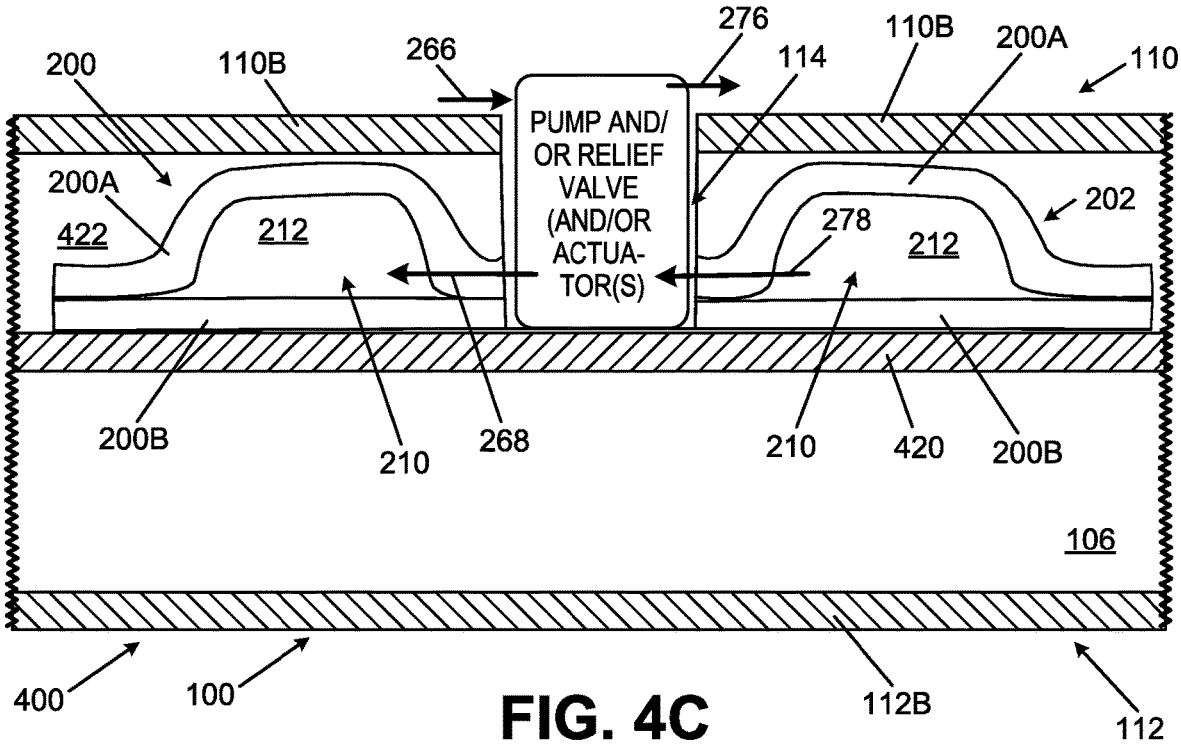

FIGS. 4A-4C illustrate various views of a glove 400 in accordance with some examples of this technology having a bladder system 200 engaged with a glove base member 100. FIG. 4A is a back view of the glove 400 and FIGS. 4B and 4C provide partial cross-sectional views taken along line 4B-4B in FIG. 4A. As shown in FIG. 4A (by comparison with FIG. 1), the bladder system 200 is inserted into the glove base member 100 such that the rear opening 114 of the glove base member 100 is closed off by the fluid control components (e.g., pump 260, its components, relief valve 270 and/or its components). In this illustrated example, the actuators 262 and 272 for the pump 260 and relief valve 270, respectively, are exposed at the rear of the glove base member 100 through opening 114. FIG. 4A further shows the bladder system 200 in an inflated (or pressurized) condition, as apparent from the raised ridges 410 in the fabric material of the glove base member 100 corresponding to the fluid-filled chamber 212 locations (and the unbonded regions 210 of bladder component 202) and the recesses 412 corresponding to the bonded regions 220 of bladder component 202. When pumped up, the unbonded regions 210 of the bladder system 200 may displace the material (e.g., fabric material) of the glove base member 100, thereby creating the raised ridges 410 and recesses 412.

FIGS. 4B and 4C illustrate partial cross-sectional views of bladder systems 200 engaged with a glove base member 100, e.g., of the types described above in conjunction with FIG. 1 (e.g., including rear component(s) 110 and front component(s) 112). In the example of FIG. 4B, the bladder system 200 is of the type described above in conjunction with FIG. 3B, and in the example of FIG. 4C, the bladder system 200 is of the type described above in conjunction with FIG. 3C. In these illustrated examples, component 420 may constitute the base member 250 discussed above, or it may constitute an interior component within the glove base member 100 (e.g., an interior pocket or liner sewn or otherwise attached to components 110 and/or 112). Component 420 may be engaged with one or both of glove member 100 rear component(s) 110 and/or one or more of glove member 100 front component(s) 112. Component 420 and rear glove component(s) 110 in these example structures define a chamber 422 for receiving at least a portion of the bladder system 200. The bladder system 200 is inserted in chamber 422 such that the fluid control components (e.g., pump 260, its components, relief valve 270 and/or its components) extend through and/or are exposed through opening 114 in the rear component(s) 112 of glove base member 100. Again, while FIGS. 4A-4C show the fluid control components (e.g., 260, 262, 270, 272) generally located together and in close proximity to one another, other more spaced apart mounting options for these components are possible without departing from this technology, and any desired mounting locations and/or combination and/or separation of components may be utilized.

Component 420 and front glove component(s) 112 in these example structures define interior chamber 106 for receiving the wearer's hand. Thus, in each of these example structures, the bladder systems 200 engage the back of a wearer's hand (when the hand is inserted in the intended manner into the interior chamber 106). This leaves the front of the hand and glove 100 available for desired activities, such as sports activities (e.g., engaging a ball, performing goalkeeper functions, etc.). In some examples of this technology, rear glove component(s) 110 and/or front glove component(s) 112 may be structured and/or equipped with components that are conventional and used in the relevant glove art, e.g., to contain padding, to include grip-enhancing features, to include reinforcements, etc.

Component 420 (which may correspond to base member 250) may be made from any desired material and/or combination of materials, such as fabric material, plastic materials (e.g., thermoplastics, etc.), etc. The choice of material (s) and/or the structure of component 420 and/or base member 250 can be used to control properties of the glove 400 product. For example, when component 420 and/or base member 250 is formed from a conventional fabric material, the glove 400 may remain quite flexible (e.g., to flex with the wearer's hand, to displace under an applied force (e.g., from inflation of bladder 200), etc.). When component 420 and/or base member 250 is formed at least in part from a stiffer material (e.g., a plastic material, such as a thermoplastic), the glove 400's stiffness and rigidity can be modified and controlled. As another example, if desired, at least some portions of component 420 and/or base member 250 may include stiffer materials and/or otherwise be structured and arranged to act as finger protection (or a "finger saver"), e.g., as are provided in at least some types of goalkeeper's gloves. A single component 420 and/or base member 250 may have constant stiffness and/or rigidity throughout its overall area or it may have varying stiffness and/or rigidity.

Figure 5A:
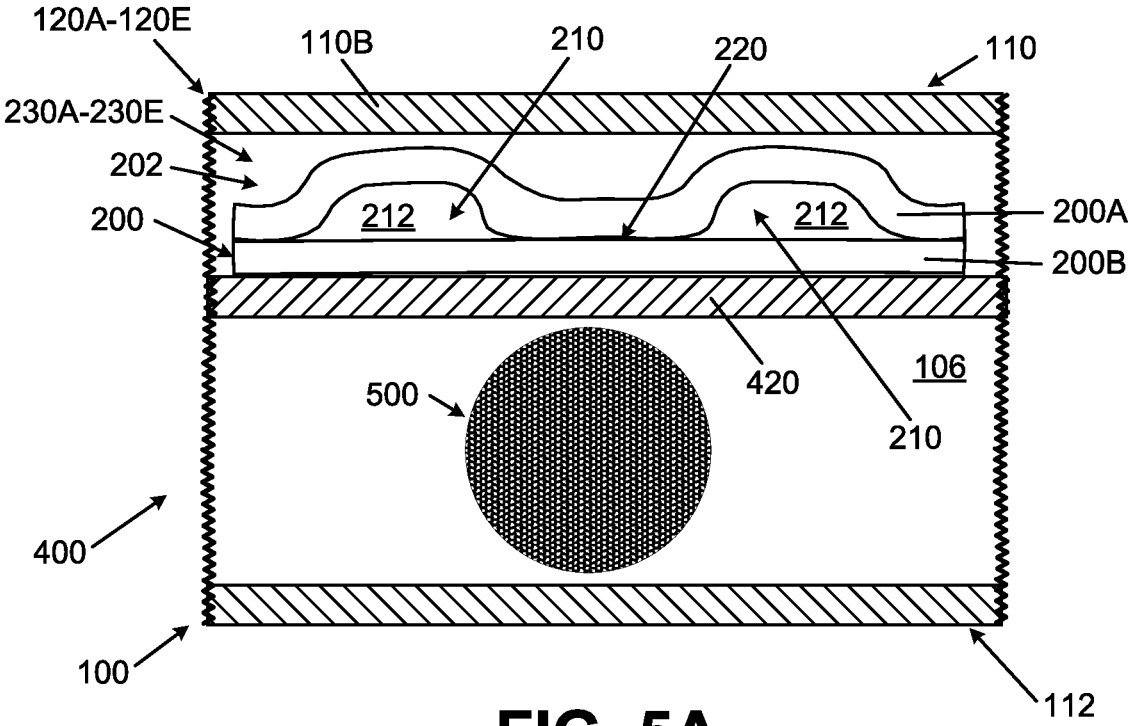
FIGS. 5A-6B illustrate examples and/or features of gloves including bladder systems in accordance with some examples of this technology as they change between an uninflated state (FIGS. 5A and 6A) and an inflated state (FIGS. 5B and 6B).
Figure 5B:
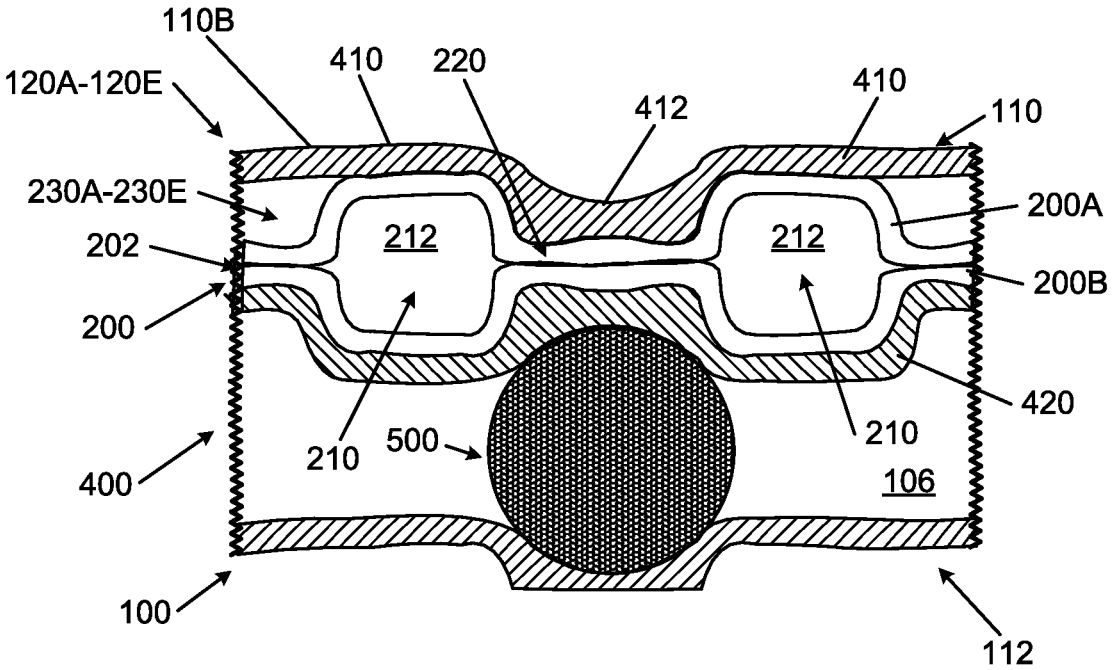

FIGS. 5A and 5B include partial cross-sectional view (e.g., at location 5-5 shown in FIG. 4A) of a digit-engaging region 120A-120E of a glove base member 100 and a digit-engaging region 230A-230E of a bladder system 200. FIG. 5A shows these regions 120A-120E and 230A-230E in an uninflated state, and FIG. 5B shows these regions 120A-120E and 230A-230E in an inflated state to engage a wearer's finger 500. As shown, inflation of the bladder system 200 in this example: (a) causes the material of the rear component(s) 110B of the glove base member 100 to displace, thereby forming raised ridges 410 and recesses 412 and (b) causes the material of the intermediate component 420 to displace, thereby engaging and partially wrapping the wearer's finger 500. In some examples, the front glove component 112 also may be displaced somewhat, e.g., when the bladder system 200 is inflated and the wearer's finger 500 is engaged. See FIG. 5B. The raised ridges 410 are formed at locations that correspond with the location(s) of the unbonded region(s) 210 due to inflation of the fluid chamber 212. The recesses 412 adjacent the raised ridges 410 are formed at locations that correspond with the location (s) of the bonded regions 220 due to the lack of displacing force applied to the rear glove component(s) 110 by the bladder component 202 at the bonded region(s) 220 (e.g., bonding sheet 200A to sheet 200B prevents the bladder component 202 from expanding outward at the bonded region(s) 220 when the bladder component 202 is inflated). Such inflation can help the glove 100 better engage and fit the wearer's hand, better position the wearer's hand within the glove 100, and/or better hold the wearer's hand in place in the glove 100. Inflation of the bladder component 202 also can provide cushioning or impact force attenuation. In some examples of this technology, these improved features may be realized, e.g., due to size adjustment realized by displacement of components 110 and/or 420, due to the formation of a digit seating area for the wearer's digits at the bonded region(s) 220 of the bladder system 200, and/or due to securing pressure applied to the wearer's digits by pressurized fluid in fluid chamber 212.

Figure 6A:
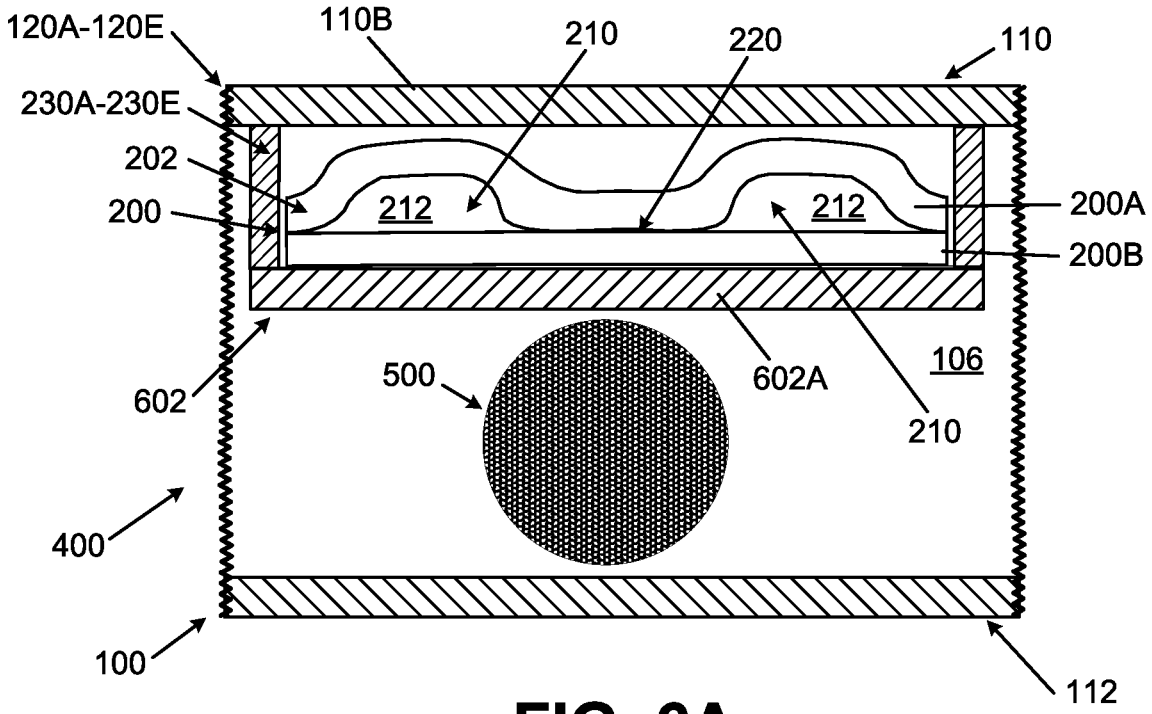
Figure 6B:
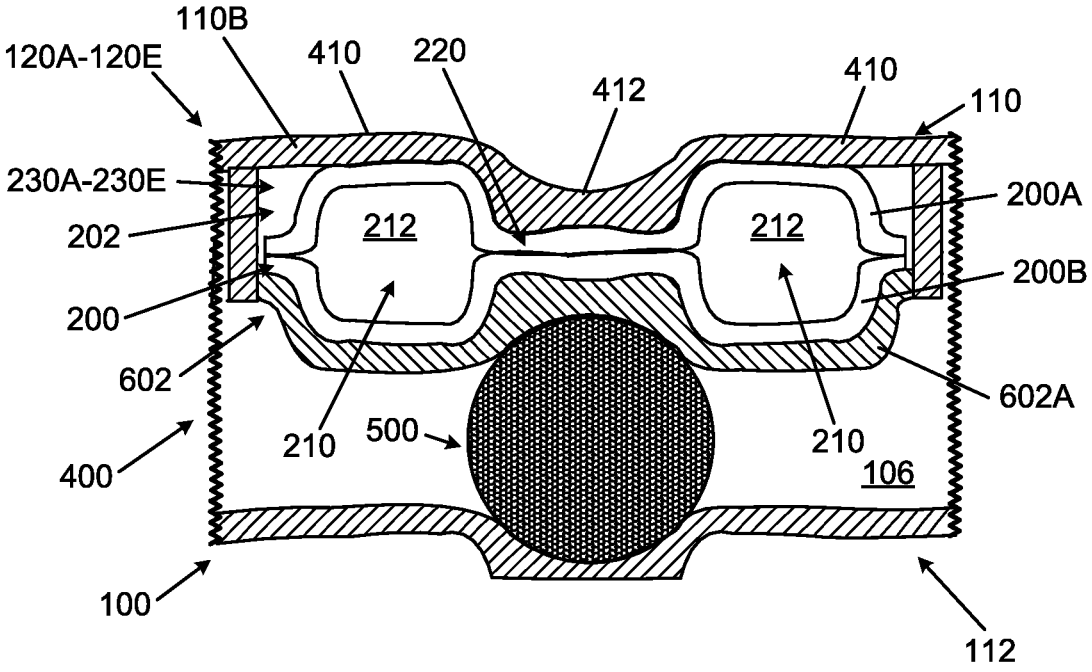

FIGS. 6A and 6B include partial cross-sectional views (e.g., at location 5-5 shown in FIG. 4A) of a digit-engaging region 120A-120E of a glove base member 100 and a digit-engaging region 230A-230E of a bladder system 200 changing from an uninflated state (FIG. 6A) to an inflated state (FIG. 6B). In this example structure, however, the bladder system 200 (or at least this illustrated portion thereof) is included within a pocket 602 provided within the glove base member 100. The pocket 602 may be engaged with one or more components 110 and/or 112 of the glove base member 100 in any desired manner, e.g., by sewing, by fuse bonding, by adhesives, and/or by mechanical connectors. In this illustrated example, inflation of the bladder system 200 expands the size of the pocket 602 at least by displacing one or both of the material of the rear component (s) 110 of the glove base member 100 and/or the bottom layer 602A of the pocket 602. Also, as shown in FIG. 6B, in some examples of this technology, the rear component(s) 110 of the glove base member 100 and/or the bottom layer 602A of the pocket 602 may displace to form raised ridges 410 and recesses 412 and/or to engage a wearer's finger, e.g., in a manner similar to that shown in FIG. 5B. The front glove component 112 also may be displaced somewhat, e.g., when the bladder is inflated and the wearer's finger 500 is engaged. Thus, the example structure shown in FIGS. 6A and 6B can help the glove 100 better engage and fit the wearer's hand, better position the wearer's hand within the glove 100, better hold the wearer's hand in place within the glove 100, provide cushioning or impact force attenuation, etc. In the same general manner as FIGS. 5A and 5B, these improved features may be realized, e.g., due to size adjustment realized by displacement of components 110B and 602A, due to the formation of a seating area for the wearer's digits at the bonded region(s) 220 of the bladder system 200, and/or due to securing pressure applied to the wearer's digits by pressurized fluid in fluid chamber 212.

Bladder systems 200 and/or bladder components 202 in accordance with aspects of this technology may have other features. For example, as described above, FIG. 2A illustrates a bladder system 200 including bladder component 202. As bonded regions 220, this example bladder component 202 includes: (a) an outermost perimeter bond 220P that extends (continuously or discontinuously) around at least a portion (up to 100%) of the outer perimeter edge of the bladder system 200 and bladder component 202 to define at least a portion of the outer edge of the bladder component 202; (b) central digit-engaging bonded regions 222A-222E (including the contiguously formed knuckle flexion regions 224A-224N), e.g., one central digit-engaging bonded region 222A-222E for each digit; and (c) a bonded region at the base area 240 for supporting the fluid control components (e.g., pump 260 and/or relief valve 270 and/or their components). In some examples of this technology, the bonded regions 220 of a bladder component 202 will consist of or consist essentially of: (a) an outermost perimeter bond 220P that extends (continuously or discontinuously) around at least a portion (up to 100%) of the outer perimeter edge of the bladder system 200 and bladder component 202 to define at least a portion of the outer edge of the bladder component 202; and (b) a single digit-engaging bonded regions (e.g., bonded regions 222A-222E including any present and contiguously formed knuckle flexion regions 224A-224N) for each digit-engaging region present (e.g., 230A-230E) in the bladder system 200, up to five total digit-engaging bonded regions 222A-222E. In other examples of this technology, the bonded regions 220 of a bladder component 202 will consist of or consist essentially of: (a) an outermost perimeter bond 220P that extends (continuously or discontinuously) around at least a portion (up to 100%) of the outer perimeter edge of the bladder system 200 and bladder component 202 to define at least a portion of the outer edge of the bladder component 202; (b) a single digit-engaging bonded regions (e.g., bonded regions 222A-222E including any present and contiguously formed knuckle flexion regions 224A-224N) for each digit-engaging region present (e.g., 230A-230E) in the bladder system 200, up to five total digit-engaging bonded regions 222A-222E; and (c) a bonded region at the base area (e.g., for supporting fluid control components (e.g., pump 260 and relief valve 270).

Also, as shown in FIG. 2A, an outermost perimeter edge of the bladder component 202 defines a total area. The outermost perimeter edge may be defined, at least in part, by the outermost perimeter bond 220P (which may extend (continuously or discontinuously) around at least a portion of the outer perimeter edge of the bladder system 200 and bladder component 202 to define at least a portion of the outer edge of the bladder component 202, up to 100% of the outer perimeter edge of the bladder system 200 and/or bladder component 202). The outer perimeter edge of the bladder component 202 defines a total area $A_T$. In some examples of this technology, the plurality of separated bonded regions included in the bladder component 202 define a total bonded area $A_{B1}$ (a total of the area of all bonded regions combined, including in this illustrated example: (i) the outermost perimeter bond 220P, (ii) the digit-engaging area bonds 222A-222E (including any present knuckle-flexion regions 224A-224N formed as bonded area 220), and (iii) the base region 240 bonded area) may constitute from 15% to 65% of the total area $A_T$, and in some examples, from 18% to 55% of the total area $A_T$, or even from 20% to 45% of the total area $A_T$. Additionally or alternatively, in some examples of this technology, the plurality of separated bonded regions forming the digit-engaging bonded regions (e.g., bonded regions 222A-222E including any present knuckle-flexion regions 224A-224N formed as bonded area 220) may cover an area $A_{B2}$ constituting from 10% to 60% of the total area $A_T$, and in some examples, from 12% to 50% of the total area $A_T$, or even from 15% to 40% of the total area $A_T$.

III. Conclusion

The present invention is disclosed above and in the accompanying drawings with reference to a variety of embodiments and/or options. The purpose served by the disclosure, however, is to provide examples of various features and concepts related to the invention, not to limit the scope of the invention. One skilled in the relevant art will recognize that numerous variations and modifications may be made to the features of the invention described above without departing from the scope of the present invention, as defined by the appended claims.

For the avoidance of doubt, the present application includes at least the subject matter described in the following numbered Clauses:

Clause 1. A Bladder System, Comprising:

a bladder component including a first wall and a second wall, wherein a fluid chamber is defined between the first wall and the second wall, wherein the bladder component includes: (i) an unbonded region where an interior surface of the first wall is unattached to an interior surface of the second wall, the unbonded region defining the fluid chamber, and (ii) a plurality of separated bonded regions where the interior surface of the first wall is attached to the interior surface of the second wall, wherein the unbonded region defines the fluid chamber as an outer perimeter fluid chamber that extends continuously to form (i) a first digit-engaging region having a first side perimeter edge chamber and a second side perimeter edge chamber and (ii) a second digit-engaging region having a third side perimeter edge chamber and a fourth side perimeter edge chamber, wherein a first bonded region of the plurality of separated bonded regions extends continuously in a direction along a length direction of the first digit-engaging region to separate the first side perimeter edge chamber from the second side perimeter edge chamber to form a first knuckle-flexion region and a second knuckle-flexion region separated from the first knuckle-flexion region along the length direction of the first digit-engaging region, and wherein a second bonded region of the plurality of separated bonded regions extends continuously in a direction along a length direction of the second digit-engaging region to separate the third side perimeter edge chamber from the fourth side perimeter edge chamber and to form a third knuckle-flexion region and a fourth knuckle-flexion region separated from the third knuckle-flexion region along the length direction of the second digit-engaging region.

Clause 2. The bladder system according to Clause 1, wherein the second bonded region extends continuously along the length direction of the second digit-engaging region to form a fifth knuckle-flexion region separated from the third knuckle-flexion region and the fourth knuckle-flexion region along the length direction of the second digit-engaging region.

Clause 3. The bladder system according to Clause 1, wherein the outer perimeter fluid chamber further extends continuously to form a third digit-engaging region having a fifth side perimeter edge chamber and a sixth side perimeter edge chamber, and wherein a third bonded region of the plurality of separated bonded regions extends continuously in a direction along a length direction of the third digit-engaging region to separate the fifth side perimeter edge chamber from the sixth side perimeter edge chamber and to form a fifth knuckle-flexion region and a sixth knuckle-flexion region separated from the fifth knuckle-flexion region along the length direction of the third digit-engaging region.

Clause 4. The bladder system according to Clause 3, wherein the second bonded region extends continuously along the length direction of the second digit-engaging region to form a seventh knuckle-flexion region separated from the third knuckle-flexion region and the fourth knuckle-flexion region along the length direction of the second digit-engaging region, and wherein the third bonded region extends continuously along the length direction of the third digit-engaging region to form an eighth knuckle-flexion region separated from the fifth knuckle-flexion region and the sixth knuckle-flexion region along the length direction of the third digit-engaging region.

Clause 5. The bladder system according to Clause 3, wherein the outer perimeter fluid chamber further extends continuously to form a fourth digit-engaging region having a seventh side perimeter edge chamber and an eighth side perimeter edge chamber, and wherein a fourth bonded region of the plurality of separated bonded regions extends continuously in a direction along a length direction of the fourth digit-engaging region to separate the seventh side perimeter edge chamber from the eighth side perimeter edge chamber and to form a seventh knuckle-flexion region and an eighth knuckle-flexion region separated from the seventh knuckle-flexion region along the length direction of the fourth digit-engaging region.

Clause 6. The bladder system according to Clause 5, wherein the second bonded region extends continuously along the length direction of the second digit-engaging region to form a ninth knuckle-flexion region separated from the third knuckle-flexion region and the fourth knuckle-flexion region along the length direction of the second digit-engaging region, wherein the third bonded region extends continuously along the length direction of the third digit-engaging region to form a tenth knuckle-flexion region separated from the fifth knuckle-flexion region and the sixth knuckle-flexion region along the length direction of the third digit-engaging region, and wherein the fourth bonded region extends continuously along the length direction of the fourth digit-engaging region to form an eleventh knuckle-flexion region separated from the seventh knuckle-flexion region and the eighth knuckle-flexion region along the length direction of the fourth digit-engaging region.

Clause 7. The bladder system according to Clause 5, wherein the outer perimeter fluid chamber further extends continuously to form a fifth digit-engaging region having a ninth side perimeter edge chamber and a tenth side perimeter edge chamber, and wherein a fifth bonded region of the plurality of separated bonded regions extends continuously in a direction along a length direction of the fifth digit-engaging region to separate the ninth side perimeter edge chamber from the tenth side perimeter edge chamber and to form a ninth knuckle-flexion region and a tenth knuckle-flexion region separated from the ninth knuckle-flexion region along the length direction of the fifth digit-engaging region.

Clause 8. The bladder system according to Clause 7, wherein the second bonded region extends continuously along the length direction of the second digit-engaging region to form an eleventh knuckle-flexion region separated from the third knuckle-flexion region and the fourth knuckle-flexion region along the length direction of the second digit-engaging region, wherein the third bonded region extends continuously along the length direction of the third digit-engaging region to form a twelfth knuckle-flexion region separated from the fifth knuckle-flexion region and the sixth knuckle-flexion region along the length direction of the third digit-engaging region, wherein the fourth bonded region extends continuously along the length direction of the fourth digit-engaging region to form a thirteenth knuckle-flexion region separated from the seventh knuckle-flexion region and the eighth knuckle-flexion region along the length direction of the fourth digit-engaging region, and wherein the fifth bonded region extends continuously along the length direction of the fifth digit-engaging region to form a fourteenth knuckle-flexion region separated from the ninth knuckle-flexion region and the tenth knuckle-flexion region along the length direction of the fifth digit-engaging region.

Clause 9. The bladder system according to any one of Clauses 1-8, wherein an outermost perimeter edge of the bladder component defines a total area, and wherein the plurality of separated bonded regions form from 10% to 60% of the total area.

Clause 10. The bladder system according to Clause 9, wherein the plurality of separated bonded regions form from 12% to 50% of the total area.

Clause 11. The bladder system according to Clause 9, wherein the plurality of separated bonded regions form from 15% to 40% of the total area.

Clause 12. The bladder system according to any one of Clauses 1-11, further comprising:

a base member engaged with the bladder component.

Clause 13. The bladder system according to any one of Clauses 1-12, further comprising:

a pump in fluid communication with the fluid chamber to introduce fluid into the fluid chamber.

Clause 14. The bladder system according to any one of Clauses 1-13, further comprising:

a valve in fluid communication with the fluid chamber to release fluid from the fluid chamber.

Clause 15. A bladder system, comprising:

a bladder component including a first wall and a second wall, wherein the bladder component includes:

(a) a base region, (b) a first digit-engaging member including: (i) a first side fluid chamber defined between the first wall and the second wall, (ii) a second side fluid chamber defined between the first wall and the second wall, (iii) a first free end fluid chamber defined between the first wall and the second wall and connecting the first side fluid chamber and the second side fluid chamber, and (iv) a first bonded region where an interior surface of the first wall is bonded to an interior surface of the second wall, the first bonded region separating the first side fluid chamber and the second side fluid chamber and extending continuously from the first free end fluid chamber (e.g., to a first closed end), (c) a second digit-engaging member extending away from the base region, the second digit-engaging member including: (i) a third side fluid chamber defined between the first wall and the second wall, (ii) a fourth side fluid chamber defined between the first wall and the second wall, (iii) a second free end fluid chamber defined between the first wall and the second wall and connecting the third side fluid chamber and the fourth side fluid chamber, and (iv) a second bonded region where the interior surface of the first wall is bonded to the interior surface of the second wall, the second bonded region separating the third side fluid chamber and the fourth side fluid chamber and extending continuously from the second free end fluid chamber to the base region.

Clause 16. The bladder system according to Clause 15, wherein the first bonded region includes: (i) a first longitudinal portion extending continuously from the first free end fluid chamber (e.g., to the first closed end), (ii) a first knuckle-flexion portion intersecting the first longitudinal portion at a first longitudinal location, and (iii) a second knuckle-flexion portion separated from the first knuckle-flexion portion and intersecting the first longitudinal portion at a second longitudinal location, wherein the second longitudinal location is located a greater distance from the first free end fluid chamber than is the first longitudinal location.

Clause 17. The bladder system according to Clause 16, wherein the second bonded region includes: (i) a second longitudinal portion extending continuously from the second free end fluid chamber to the base region, (ii) a third knuckle-flexion portion intersecting the second longitudinal portion at a third longitudinal location, (iii) a fourth knuckle-flexion portion separated from the third knuckle-flexion portion and intersecting the second longitudinal portion at a fourth longitudinal location, wherein the fourth longitudinal location is located a greater distance from the second free end fluid chamber than is the third longitudinal location, and (iv) a fifth knuckle-flexion portion separated from the third knuckle-flexion portion and the fourth knuckle-flexion portion and intersecting the second longitudinal portion at a fifth longitudinal location, wherein the fifth longitudinal location is located a greater distance from the second free end fluid chamber than is the fourth longitudinal location.

Clause 18. The bladder system according to Clause 15, wherein the bladder component includes a third digit-engaging member extending away from the base region, the third digit-engaging member including: (i) a fifth side fluid chamber defined between the first wall and the second wall, (ii) a sixth side fluid chamber defined between the first wall and the second wall, (iii) a third free end fluid chamber defined between the first wall and the second wall and connecting the fifth side fluid chamber and the sixth side fluid chamber, and (iv) a third bonded region where the interior surface of the first wall is bonded to the interior surface of the second wall, the third bonded region separating the fifth side fluid chamber and the sixth side fluid chamber and extending continuously from the third free end fluid chamber to the base region.

Clause 19. The bladder system according to Clause 18, wherein the first bonded region includes: (i) a first longitudinal portion extending continuously from the first free end fluid chamber (e.g., to the first closed end), (ii) a first knuckle-flexion portion intersecting the first longitudinal portion at a first longitudinal location, and (iii) a second knuckle-flexion portion separated from the first knuckle-flexion portion and intersecting the first longitudinal portion at a second longitudinal location, wherein the second longitudinal location is located a greater distance from the first free end fluid chamber than is the first longitudinal location, wherein the second bonded region includes: (i) a second longitudinal portion extending continuously from the second free end fluid chamber to the base region, (ii) a third knuckle-flexion portion intersecting the second longitudinal portion at a third longitudinal location, (iii) a fourth knuckle-flexion portion separated from the third knuckle-flexion portion and intersecting the second longitudinal portion at a fourth longitudinal location, wherein the fourth longitudinal location is located a greater distance from the second free end fluid chamber than is the third longitudinal location, and (iv) a fifth knuckle-flexion portion separated from the third knuckle-flexion portion and the fourth knuckle-flexion portion and intersecting the second longitudinal portion at a fifth longitudinal location, wherein the fifth longitudinal location is located a greater distance from the second free end fluid chamber than is the fourth longitudinal location, and wherein the third bonded region includes: (i) a third longitudinal portion extending continuously from the third free end fluid chamber to the base region, (ii) a sixth knuckle-flexion portion intersecting the third longitudinal portion at a sixth longitudinal location, (iii) a seventh knuckle-flexion portion separated from the sixth knuckle-flexion portion and intersecting the third longitudinal portion at a seventh longitudinal location, wherein the seventh longitudinal location is located a greater distance from the third free end fluid chamber than is the sixth longitudinal location, and (iv) an eighth knuckle-flexion portion separated from the sixth knuckle-flexion portion and the seventh knuckle-flexion portion and intersecting the third longitudinal portion at an eighth longitudinal location, wherein the eighth longitudinal location is located a greater distance from the third free end fluid chamber than is the seventh longitudinal location.

Clause 20. The bladder system according to Clause 18, wherein the bladder component includes a fourth digit-engaging member extending away from the base region, the fourth digit-engaging member including: (i) a seventh side fluid chamber defined between the first wall and the second wall, (ii) an eighth side fluid chamber defined between the first wall and the second wall, (iii) a fourth free end fluid chamber defined between the first wall and the second wall and connecting the seventh side fluid chamber and the eighth side fluid chamber, and (iv) a fourth bonded region where the interior surface of the first wall is bonded to the interior surface of the second wall, the fourth bonded region separating the seventh side fluid chamber and the eighth side fluid chamber and extending continuously from the fourth free end fluid chamber to the base region.

Clause 21. The bladder system according to Clause 20, wherein the first bonded region includes: (i) a first longitudinal portion extending continuously from the first free end fluid chamber (e.g., to the first closed end), (ii) a first knuckle-flexion portion intersecting the first longitudinal portion at a first longitudinal location, and (iii) a second knuckle-flexion portion separated from the first knuckle-flexion portion and intersecting the first longitudinal portion at a second longitudinal location, wherein the second longitudinal location is located a greater distance from the first free end fluid chamber than is the first longitudinal location, wherein the second bonded region includes: (i) a second longitudinal portion extending continuously from the second free end fluid chamber to the base region, (ii) a third knuckle-flexion portion intersecting the second longitudinal portion at a third longitudinal location, (iii) a fourth knuckle-flexion portion separated from the third knuckle-flexion portion and intersecting the second longitudinal portion at a fourth longitudinal location, wherein the fourth longitudinal location is located a greater distance from the second free end fluid chamber than is the third longitudinal location, and (iv) a fifth knuckle-flexion portion separated from the third knuckle-flexion portion and the fourth knuckle-flexion portion and intersecting the second longitudinal portion at a fifth longitudinal location, wherein the fifth longitudinal location is located a greater distance from the second free end fluid chamber than is the fourth longitudinal location, wherein the third bonded region includes: (i) a third longitudinal portion extending continuously from the third free end fluid chamber to the base region, (ii) a sixth knuckle-flexion portion intersecting the third longitudinal portion at a sixth longitudinal location, (iii) a seventh knuckle-flexion portion separated from the sixth knuckle-flexion portion and intersecting the third longitudinal portion at a seventh longitudinal location, wherein the seventh longitudinal location is located a greater distance from the third free end fluid chamber than is the sixth longitudinal location, and (iv) an eighth knuckle-flexion portion separated from the sixth knuckle-flexion portion and the seventh knuckle-flexion portion and intersecting the third longitudinal portion at an eighth longitudinal location, wherein the eighth longitudinal location is located a greater distance from the third free end fluid chamber than is the seventh longitudinal location, and wherein the fourth bonded region includes: (i) a fourth longitudinal portion extending continuously from the fourth free end fluid chamber to the base region, (ii) a ninth knuckle-flexion portion intersecting the fourth longitudinal portion at a ninth longitudinal location, (iii) a tenth knuckle-flexion portion separated from the ninth knuckle-flexion portion and intersecting the fourth longitudinal portion at a tenth longitudinal location, wherein the tenth longitudinal location is located a greater distance from the fourth free end fluid chamber than is the ninth longitudinal location, and (iv) an eleventh knuckle-flexion portion separated from the ninth knuckle-flexion portion and the tenth knuckle-flexion portion and intersecting the fourth longitudinal portion at an eleventh longitudinal location, wherein the eleventh longitudinal location is located a greater distance from the fourth free end fluid chamber than is the tenth longitudinal location.

Clause 22. The bladder system according to Clause 20, wherein the bladder component includes a fifth digit-engaging member extending away from the base region, the fifth digit-engaging member including: (i) a ninth side fluid chamber defined between the first wall and the second wall, (ii) a tenth side fluid chamber defined between the first wall and the second wall, (iii) a fifth free end fluid chamber defined between the first wall and the second wall and connecting the ninth side fluid chamber and the tenth side fluid chamber, and (iv) a fifth bonded region where the interior surface of the first wall is bonded to the interior surface of the second wall, the fifth bonded region separating the ninth side fluid chamber and the tenth side fluid chamber and extending continuously from the fifth free end fluid chamber to the base region.

Clause 23. The bladder system according to Clause 22, wherein the first bonded region includes: (i) a first longitudinal portion extending continuously from the first free end fluid chamber (e.g., to the first closed end), (ii) a first knuckle-flexion portion intersecting the first longitudinal portion at a first longitudinal location, and (iii) a second knuckle-flexion portion separated from the first knuckle-flexion portion and intersecting the first longitudinal portion at a second longitudinal location, wherein the second longitudinal location is located a greater distance from the first free end fluid chamber than is the first longitudinal location, wherein the second bonded region includes: (i) a second longitudinal portion extending continuously from the second free end fluid chamber to the base region, (ii) a third knuckle-flexion portion intersecting the second longitudinal portion at a third longitudinal location, (iii) a fourth knuckle-flexion portion separated from the third knuckle-flexion portion and intersecting the second longitudinal portion at a fourth longitudinal location, wherein the fourth longitudinal location is located a greater distance from the second free end fluid chamber than is the third longitudinal location, and (iv) a fifth knuckle-flexion portion separated from the third knuckle-flexion portion and the fourth knuckle-flexion portion and intersecting the second longitudinal portion at a fifth longitudinal location, wherein the fifth longitudinal location is located a greater distance from the second free end fluid chamber than is the fourth longitudinal location, wherein the third bonded region includes: (i) a third longitudinal portion extending continuously from the third free end fluid chamber to the base region, (ii) a sixth knuckle-flexion portion intersecting the third longitudinal portion at a sixth longitudinal location, (iii) a seventh knuckle-flexion portion separated from the sixth knuckle-flexion portion and intersecting the third longitudinal portion at a seventh longitudinal location, wherein the seventh longitudinal location is located a greater distance from the third free end fluid chamber than is the sixth longitudinal location, and (iv) an eighth knuckle-flexion portion separated from the sixth knuckle-flexion portion and the seventh knuckle-flexion portion and intersecting the third longitudinal portion at an eighth longitudinal location, wherein the eighth longitudinal location is located a greater distance from the third free end fluid chamber than is the seventh longitudinal location, wherein the fourth bonded region includes: (i) a fourth longitudinal portion extending continuously from the fourth free end fluid chamber to the base region, (ii) a ninth knuckle-flexion portion intersecting the fourth longitudinal portion at a ninth longitudinal location, (iii) a tenth knuckle-flexion portion separated from the ninth knuckle-flexion portion and intersecting the fourth longitudinal portion at a tenth longitudinal location, wherein the tenth longitudinal location is located a greater distance from the fourth free end fluid chamber than is the ninth longitudinal location, and (iv) an eleventh knuckle-flexion portion separated from the ninth knuckle-flexion portion and the tenth knuckle-flexion portion and intersecting the fourth longitudinal portion at an eleventh longitudinal location, wherein the eleventh longitudinal location is located a greater distance from the fourth free end fluid chamber than is the tenth longitudinal location, and wherein the fifth bonded region includes: (i) a fifth longitudinal portion extending continuously from the fifth free end fluid chamber to the base region, (ii) a twelfth knuckle-flexion portion intersecting the fifth longitudinal portion at a twelfth longitudinal location, (iii) a thirteenth knuckle-flexion portion separated from the twelfth knuckle-flexion portion and intersecting the fifth longitudinal portion at a thirteenth longitudinal location, wherein the thirteenth longitudinal location is located a greater distance from the fifth free end fluid chamber than is the twelfth longitudinal location, and (iv) a fourteenth knuckle-flexion portion separated from the thirteenth knuckle-flexion portion and the twelfth knuckle-flexion portion and intersecting the fifth longitudinal portion at a fourteenth longitudinal location, wherein the fourteenth longitudinal location is located a greater distance from the fifth free end fluid chamber than is the thirteenth longitudinal location.

Clause 24. The bladder system according to any one of Clauses 15 to 23, wherein an outermost perimeter edge of the bladder component defines a total area, and wherein a combined area of all bonded regions located within the outermost perimeter edge form from 10% to 60% of the total area.

Clause 25. The bladder system according to Clause 24, wherein the combined area of all bonded regions located within the outermost perimeter edge form from 12% to 50% of the total area.

Clause 26. The bladder system according to Clause 24, wherein the combined area of all bonded regions located within the outermost perimeter edge form from 15% to 40% of the total area.

Clause 27. The bladder system according to any one of Clauses 15 to 26, further comprising: a base member engaged with the bladder component.

Clause 28. The bladder system according to any one of Clauses 15 to 27, further comprising: a pump for introducing fluid into the bladder component.

Clause 29. The bladder system according to Clause 28, wherein the pump is engaged with the base region of the bladder component.

Clause 30. The bladder system according to any one of Clauses 15 to 29, further comprising: a valve for releasing fluid from the bladder component.

Clause 31. The bladder system according to Clause 30, wherein the valve is engaged with the base region of the bladder component.

Clause 32. A bladder system, comprising:

a bladder component including a first wall and a second wall, wherein the bladder component includes:

(a) a first digit-engaging member including: (i) a first side fluid chamber defined between the first wall and the second wall, (ii) a second side fluid chamber defined between the first wall and the second wall, (iii) a first free end fluid chamber defined between the first wall and the second wall and connecting the first side fluid chamber and the second side fluid chamber, and (iv) a first space separating the first side fluid chamber and the second side fluid chamber and extending continuously from the first free end fluid chamber (e.g., to a first closed end) and substantially an entire longitudinal length of the first digit-engaging member, (b) a second digit-engaging member including: (i) a third side fluid chamber defined between the first wall and the second wall, (ii) a fourth side fluid chamber defined between the first wall and the second wall, (iii) a second free end fluid chamber defined between the first wall and the second wall and connecting the third side fluid chamber and the fourth side fluid chamber, and (iv) a second space separating the third side fluid chamber and the fourth side fluid chamber and extending continuously from the second free end fluid chamber (e.g., to a second closed end) and substantially an entire longitudinal length of the second digit-engaging member.

Clause 33. The bladder system according to Clause 32, wherein the first space is shaped to include: (i) a first longitudinal portion extending continuously from the first free end fluid chamber (e.g., to the first closed end), (ii) a first knuckle-flexion portion intersecting the first longitudinal portion at a first longitudinal location, and (iii) a second knuckle-flexion portion separated from the first knuckle-flexion portion and intersecting the first longitudinal portion at a second longitudinal location, wherein the second longitudinal location is located a greater distance from the first free end fluid chamber than is the first longitudinal location.

Clause 34. The bladder system according to Clause 33, wherein the second space is shaped to include: (i) a second longitudinal portion extending continuously from the second free end fluid chamber (e.g., to the second closed end), (ii) a third knuckle-flexion portion intersecting the second longitudinal portion at a third longitudinal location, (iii) a fourth knuckle-flexion portion separated from the third knuckle-flexion portion and intersecting the second longitudinal portion at a fourth longitudinal location, wherein the fourth longitudinal location is located a greater distance from the second free end fluid chamber than is the third longitudinal location, and (iv) a fifth knuckle-flexion portion separated from the third knuckle-flexion portion and the fourth knuckle-flexion portion and intersecting the second longitudinal portion at a fifth longitudinal location, wherein the fifth longitudinal location is located a greater distance from the second free end fluid chamber than is the fourth longitudinal location.

Clause 35. The bladder system according to Clause 32, wherein the bladder component includes a third digit-engaging member including: (i) a fifth side fluid chamber defined between the first wall and the second wall, (ii) a sixth side fluid chamber defined between the first wall and the second wall, (iii) a third free end fluid chamber defined between the first wall and the second wall and connecting the fifth side fluid chamber and the sixth side fluid chamber, and (iv) a third space separating the fifth side fluid chamber and the sixth side fluid chamber and extending continuously from the third free end fluid chamber (e.g., to a third closed end) and substantially an entire longitudinal length of the third digit-engaging member.

Clause 36. The bladder system according to Clause 35, wherein the first space is shaped to include: (i) a first longitudinal portion extending continuously from the first free end fluid chamber (e.g., to the first closed end), (ii) a first knuckle-flexion portion intersecting the first longitudinal portion at a first longitudinal location, and (iii) a second knuckle-flexion portion separated from the first knuckle-flexion portion and intersecting the first longitudinal portion at a second longitudinal location, wherein the second longitudinal location is located a greater distance from the first free end fluid chamber than is the first longitudinal location, wherein the second space is shaped to include: (i) a second longitudinal portion extending continuously from the second free end fluid chamber (e.g., to the second closed end), (ii) a third knuckle-flexion portion intersecting the second longitudinal portion at a third longitudinal location, (iii) a fourth knuckle-flexion portion separated from the third knuckle-flexion portion and intersecting the second longitudinal portion at a fourth longitudinal location, wherein the fourth longitudinal location is located a greater distance from the second free end fluid chamber than is the third longitudinal location, and (iv) a fifth knuckle-flexion portion separated from the third knuckle-flexion portion and the fourth knuckle-flexion portion and intersecting the second longitudinal portion at a fifth longitudinal location, wherein the fifth longitudinal location is located a greater distance from the second free end fluid chamber than is the fourth longitudinal location, and wherein the third space is shaped to include: (i) a third longitudinal portion extending continuously from the third free end fluid chamber (e.g., to the third closed end), (ii) a sixth knuckle-flexion portion intersecting the third longitudinal portion at a sixth longitudinal location, (iii) a seventh knuckle-flexion portion separated from the sixth knuckle-flexion portion and intersecting the third longitudinal portion at a seventh longitudinal location, wherein the seventh longitudinal location is located a greater distance from the third free end fluid chamber than is the sixth longitudinal location, and (iv) an eighth knuckle-flexion portion separated from the sixth knuckle-flexion portion and the seventh knuckle-flexion portion and intersecting the third longitudinal portion at an eighth longitudinal location, wherein the eighth longitudinal location is located a greater distance from the third free end fluid chamber than is the seventh longitudinal location.

Clause 37. The bladder system according to Clause 35, wherein the bladder component includes a fourth digit-engaging member including: (i) a seventh side fluid chamber defined between the first wall and the second wall, (ii) an eighth side fluid chamber defined between the first wall and the second wall, (iii) a fourth free end fluid chamber defined between the first wall and the second wall and connecting the seventh side fluid chamber and the eighth side fluid chamber, and (iv) a fourth space separating the seventh side fluid chamber and the eighth side fluid chamber and extending continuously from the fourth free end fluid chamber (e.g., to a fourth closed end) and substantially an entire longitudinal length of the fourth digit-engaging member.

Clause 38. The bladder system according to Clause 37, wherein the first space is shaped to include: (i) a first longitudinal portion extending continuously from the first free end fluid chamber (e.g., to the first closed end), (ii) a first knuckle-flexion portion intersecting the first longitudinal portion at a first longitudinal location, and (iii) a second knuckle-flexion portion separated from the first knuckle-flexion portion and intersecting the first longitudinal portion at a second longitudinal location, wherein the second longitudinal location is located a greater distance from the first free end fluid chamber than is the first longitudinal location, wherein the second space is shaped to include: (i) a second longitudinal portion extending continuously from the second free end fluid chamber (e.g., to the second closed end), (ii) a third knuckle-flexion portion intersecting the second longitudinal portion at a third longitudinal location, (iii) a fourth knuckle-flexion portion separated from the third knuckle-flexion portion and intersecting the second longitudinal portion at a fourth longitudinal location, wherein the fourth longitudinal location is located a greater distance from the second free end fluid chamber than is the third longitudinal location, and (iv) a fifth knuckle-flexion portion separated from the third knuckle-flexion portion and the fourth knuckle-flexion portion and intersecting the second longitudinal portion at a fifth longitudinal location, wherein the fifth longitudinal location is located a greater distance from the second free end fluid chamber than is the fourth longitudinal location, wherein the third space is shaped to include: (i) a third longitudinal portion extending continuously from the third free end fluid chamber (e.g., to the third closed end), (ii) a sixth knuckle-flexion portion intersecting the third longitudinal portion at a sixth longitudinal location, (iii) a seventh knuckle-flexion portion separated from the sixth knuckle-flexion portion and intersecting the third longitudinal portion at a seventh longitudinal location, wherein the seventh longitudinal location is located a greater distance from the third free end fluid chamber than is the sixth longitudinal location, and (iv) an eighth knuckle-flexion portion separated from the sixth knuckle-flexion portion and the seventh knuckle-flexion portion and intersecting the third longitudinal portion at an eighth longitudinal location, wherein the eighth longitudinal location is located a greater distance from the third free end fluid chamber than is the seventh longitudinal location, and wherein the fourth space is shaped to include: (i) a fourth longitudinal portion extending continuously from the fourth free end fluid chamber (e.g., to the fourth closed end), (ii) a ninth knuckle-flexion portion intersecting the fourth longitudinal portion at a ninth longitudinal location, (iii) a tenth knuckle-flexion portion separated from the ninth knuckle-flexion portion and intersecting the fourth longitudinal portion at a tenth longitudinal location, wherein the tenth longitudinal location is located a greater distance from the fourth free end fluid chamber than is the ninth longitudinal location, and (iv) an eleventh knuckle-flexion portion separated from the ninth knuckle-flexion portion and the tenth knuckle-flexion portion and intersecting the fourth longitudinal portion at an eleventh longitudinal location, wherein the eleventh longitudinal location is located a greater distance from the fourth free end fluid chamber than is the tenth longitudinal location.

Clause 39. The bladder system according to Clause 37, wherein the bladder component includes a fifth digit-engaging member including: (i) a ninth side fluid chamber defined between the first wall and the second wall, (ii) a tenth side fluid chamber defined between the first wall and the second wall, (iii) a fifth free end fluid chamber defined between the first wall and the second wall and connecting the ninth side fluid chamber and the tenth side fluid chamber, and (iv) a fifth space separating the ninth side fluid chamber and the tenth side fluid chamber and extending continuously from the fifth free end fluid chamber (e.g., to a fifth closed end) and substantially an entire longitudinal length of the fifth digit-engaging member.

Clause 40. The bladder system according to Clause 39, wherein the first space is shaped to include: (i) a first longitudinal portion extending continuously from the first free end fluid chamber (e.g., to the first closed end), (ii) a first knuckle-flexion portion intersecting the first longitudinal portion at a first longitudinal location, and (iii) a second knuckle-flexion portion separated from the first knuckle-flexion portion and intersecting the first longitudinal portion at a second longitudinal location, wherein the second longitudinal location is located a greater distance from the first free end fluid chamber than is the first longitudinal location, wherein the second space is shaped to include: (i) a second longitudinal portion extending continuously from the second free end fluid chamber (e.g., to the second closed end), (ii) a third knuckle-flexion portion intersecting the second longitudinal portion at a third longitudinal location, (iii) a fourth knuckle-flexion portion separated from the third knuckle-flexion portion and intersecting the second longitudinal portion at a fourth longitudinal location, wherein the fourth longitudinal location is located a greater distance from the second free end fluid chamber than is the third longitudinal location, and (iv) a fifth knuckle-flexion portion separated from the third knuckle-flexion portion and the fourth knuckle-flexion portion and intersecting the second longitudinal portion at a fifth longitudinal location, wherein the fifth longitudinal location is located a greater distance from the second free end fluid chamber than is the fourth longitudinal location, wherein the third space is shaped to include: (i) a third longitudinal portion extending continuously from the third free end fluid chamber (e.g., to the third closed end), (ii) a sixth knuckle-flexion portion intersecting the third longitudinal portion at a sixth longitudinal location, (iii) a seventh knuckle-flexion portion separated from the sixth knuckle-flexion portion and intersecting the third longitudinal portion at a seventh longitudinal location, wherein the seventh longitudinal location is located a greater distance from the third free end fluid chamber than is the sixth longitudinal location, and (iv) an eighth knuckle-flexion portion separated from the sixth knuckle-flexion portion and the seventh knuckle-flexion portion and intersecting the third longitudinal portion at an eighth longitudinal location, wherein the eighth longitudinal location is located a greater distance from the third free end fluid chamber than is the seventh longitudinal location, wherein the fourth space is shaped to include: (i) a fourth longitudinal portion extending continuously from the fourth free end fluid chamber (e.g., to the fourth closed end), (ii) a ninth knuckle-flexion portion intersecting the fourth longitudinal portion at a ninth longitudinal location, (iii) a tenth knuckle-flexion portion separated from the ninth knuckle-flexion portion and intersecting the fourth longitudinal portion at a tenth longitudinal location, wherein the tenth longitudinal location is located a greater distance from the fourth free end fluid chamber than is the ninth longitudinal location, and (iv) an eleventh knuckle-flexion portion separated from the ninth knuckle-flexion portion and the tenth knuckle-flexion portion and intersecting the fourth longitudinal portion at an eleventh longitudinal location, wherein the eleventh longitudinal location is located a greater distance from the fourth free end fluid chamber than is the tenth longitudinal location, and wherein the fifth space is shaped to include: (i) a fifth longitudinal portion extending continuously from the fifth free end fluid chamber (e.g., to the fifth closed end), (ii) a twelfth knuckle-flexion portion intersecting the fifth longitudinal portion at a twelfth longitudinal location, (iii) a thirteenth knuckle-flexion portion separated from the twelfth knuckle-flexion portion and intersecting the fifth longitudinal portion at a thirteenth longitudinal location, wherein the thirteenth longitudinal location is located a greater distance from the fifth free end fluid chamber than is the twelfth longitudinal location, and (iv) a fourteenth knuckle-flexion portion separated from the thirteenth knuckle-flexion portion and the twelfth knuckle-flexion portion and intersecting the fifth longitudinal portion at a fourteenth longitudinal location, wherein the fourteenth longitudinal location is located a greater distance from the fifth free end fluid chamber than is the thirteenth longitudinal location.

Clause 41. The bladder system according to any one of Clauses 32 to 40, wherein an outermost perimeter edge of the bladder component defines a total area, and wherein a combined area of all the spaces located within the outermost perimeter edge form from 10% to 60% of the total area.

Clause 42. The bladder system according to Clause 41, wherein the combined area of all the spaces located within the outermost perimeter edge form from 12% to 50% of the total area.

Clause 43. The bladder system according to Clause 41, wherein the combined area of all the spaces located within the outermost perimeter edge form from 15% to 40% of the total area.

Clause 44. The bladder system according to any one of Clauses 32 to 43, further comprising: a base member engaged with the bladder component.

Clause 45. The bladder system according to Clause 44, wherein the base member is exposed in the spaces between fluid chambers of the digit-engaging members.

Clause 46. The bladder system according to any one of Clauses 32 to 43, wherein one or more of the spaces constitute openings extending completely through the bladder component.

Clause 47. The bladder system according to any one of Clauses 32 to 43, wherein one or more of the spaces constitute bonded portions of the bladder component where an interior surface of the first wall is bonded to an interior surface of the second wall.

Clause 48. The bladder system according to any one of Clauses 32 to 47, further comprising: a pump for introducing fluid into the bladder component.

Clause 49. The bladder system according to any one of Clauses 32 to 48, further comprising: a valve for releasing fluid from the bladder component.

Clause 50. A glove, comprising: a glove base member; and a bladder system according to any preceding Clause engaged with the glove base member.

Clause 51. The glove according to Clause 50, wherein the glove base member includes a front component and a support component, and wherein the bladder system is engaged with the support component.

Clause 52. The glove according to Clause 50, wherein the glove base member includes a front component, a support component, and an interior pocket, and wherein the bladder system is included in the interior pocket.

Clause 53. The glove according to Clause 50, wherein the glove base member includes a front component, a support component, and an intermediate component located between the front component and the support component, and wherein the bladder system is included in an area between the support component and the intermediate component.

Clause 54. The glove according to any one of Clauses 51 to 53, wherein a hand-receiving chamber is defined between the front component and the bladder system.

Clause 55. The glove according to Clause 50, wherein the glove base member defines a hand-receiving chamber, and wherein the bladder system is structured and arranged to engage a back of a wearer's hand when the wearer's hand is inserted into the glove base member.

Clause 56. The glove according to any one of Clauses 50 to 55, wherein the glove is a sports glove.

Clause 57. The glove according to Clause 56, wherein the sports glove is a goalkeeper's glove.

Clause 58. The glove according to any one of Clauses 50 to 55, wherein the glove is a member selected from the group consisting of: baseball gloves; softball gloves; batting gloves; cricket gloves; golf gloves; America football gloves; weightlifting gloves; exercise gloves; and goalkeeper gloves.

What is claimed is:

1. A glove, comprising:

a glove base member, wherein the glove base member includes a plurality of separated digit-receiving compartments including a first digit-receiving compartment configured to receive only a first digit of a human hand and a second digit-receiving compartment configured to receive only a second digit of a human hand, wherein open space exterior to the glove base member separates the first digit-receiving compartment from the second digit-receiving compartment, and wherein outer edges of the plurality of separated digit-receiving compartments are unattached to one another; and a bladder system engaged with the glove base member, wherein the bladder system includes:

a bladder component including a first wall and a second wall, wherein the bladder component includes:

(a) a base region, (b) a first digit-engaging member extending into the first digit-receiving compartment of the glove base member, the first digit-engaging member including: (i) a first side fluid chamber defined between the first wall and the second wall, (ii) a second side fluid chamber defined between the first wall and the second wall, (iii) a first free end fluid chamber defined between the first wall and the second wall and connecting the first side fluid chamber and the second side fluid chamber, and (iv) a first bonded region where an interior surface of the first wall is bonded to an interior surface of the second wall, the first bonded region separating the first side fluid chamber and the second side fluid chamber and extending continuously from the first free end fluid chamber to a first closed end, wherein the first bonded region further includes: (1) a first longitudinal bonded portion extending continuously from the first free end fluid chamber to the first closed end, the first longitudinal bonded portion being located between and separating the first side fluid chamber and the second side fluid chamber, (2) a first knuckle-flexion bonded portion extending across and intersecting the first longitudinal bonded portion at a first longitudinal location, and (3) a second knuckle-flexion bonded portion separated from the first knuckle-flexion bonded portion, the second knuckle-flexion bonded portion extending across and intersecting the first longitudinal bonded portion at a second longitudinal location, wherein the second longitudinal location is located a greater distance from the first free end fluid chamber than is the first longitudinal location, and (c) a second digit-engaging member extending away from the base region and into the second digit-receiving compartment of the glove base member, the second digit-engaging member including: (i) a third side fluid chamber defined between the first wall and the second wall, (ii) a fourth side fluid chamber defined between the first wall and the second wall, (iii) a second free end fluid chamber defined between the first wall and the second wall and connecting the third side fluid chamber and the fourth side fluid chamber, and (iv) a second bonded region where the interior surface of the first wall is bonded to the interior surface of the second wall, the second bonded region separating the third side fluid chamber and the fourth side fluid chamber and extending continuously from the second free end fluid chamber to the base region, wherein the second bonded region includes: (i) a second longitudinal bonded portion extending continuously from the second free end fluid chamber to the base region, the second longitudinal bonded portion being located between and separating the third side fluid chamber and the fourth side fluid chamber, (ii) a third knuckle-flexion bonded portion extending across and intersecting the second longitudinal bonded portion at a third longitudinal location located within the second digit-receiving compartment, (iii) a fourth knuckle-flexion bonded portion separated from the third knuckle-flexion bonded portion the fourth knuckle-flexion bonded portion extending across and intersecting the second longitudinal bonded portion at a fourth longitudinal location located within the second digit-receiving compartment, wherein the fourth longitudinal location is located a greater distance from the second free end fluid chamber than is the third longitudinal location, and (iv) a fifth knuckle-flexion bonded portion separated from the third knuckle-flexion bonded portion and the fourth knuckle-flexion bonded portion, the fifth knuckle-flexion bonded portion extending across and intersecting the second longitudinal bonded portion at a fifth longitudinal location, wherein the fifth longitudinal location is located a greater distance from the second free end fluid chamber than is the fourth longitudinal location.

2. The glove according to claim 1, wherein the plurality of separated digit-receiving compartments includes a third digit-receiving compartment configured to receive only a third digit of a human hand, wherein open space exterior to the glove base member separates the third digit-receiving compartment from the first digit-receiving compartment and the second digit-receiving compartment, wherein the bladder component includes a third digit-engaging member extending away from the base region and into the third digit-receiving compartment of the glove base member, the third digit-engaging member including: (i) a fifth side fluid chamber defined between the first wall and the second wall, (ii) a sixth side fluid chamber defined between the first wall and the second wall, (iii) a third free end fluid chamber defined between the first wall and the second wall and connecting the fifth side fluid chamber and the sixth side fluid chamber, and (iv) a third bonded region where the interior surface of the first wall is bonded to the interior surface of the second wall, the third bonded region separating the fifth side fluid chamber and the sixth side fluid chamber and extending continuously from the third free end fluid chamber to the base region.

3. The glove according to claim 2, wherein the third bonded region includes: (i) a third longitudinal bonded portion extending continuously from the third free end fluid chamber to the base region, the third longitudinal bonded portion being located between and separating the fifth side fluid chamber and the sixth side fluid chamber, (ii) a sixth knuckle-flexion bonded portion extending across and intersecting the third longitudinal bonded portion at a sixth longitudinal location located within the third digit-receiving compartment, (iii) a seventh knuckle-flexion bonded portion separated from the sixth knuckle-flexion bonded portion, the seventh knuckle-flexion bonded portion extending across and intersecting the third longitudinal bonded portion at a seventh longitudinal location located within the third digit-receiving compartment, wherein the seventh longitudinal location is located a greater distance from the third free end fluid chamber than is the sixth longitudinal location, and (iv) an eighth knuckle-flexion bonded portion separated from the sixth knuckle-flexion bonded portion and the seventh knuckle-flexion bonded portion, the eighth knuckle-flexion bonded portion extending across and intersecting the third longitudinal bonded portion at an eighth longitudinal location, wherein the eighth longitudinal location is located a greater distance from the third free end fluid chamber than is the seventh longitudinal location.

4. The glove according to claim 2, wherein the plurality of separated digit-receiving compartments includes a fourth digit-receiving compartment configured to receive only a fourth digit of a human hand, wherein open space exterior to the glove base member separates the fourth digit-receiving compartment from the first digit-receiving compartment, the second digit-receiving compartment, and the third digit-receiving compartment, wherein the bladder component includes a fourth digit-engaging member extending away from the base region and into the fourth digit-receiving compartment of the glove base member, the fourth digit-engaging member including: (i) a seventh side fluid chamber defined between the first wall and the second wall, (ii) an eighth side fluid chamber defined between the first wall and the second wall, (iii) a fourth free end fluid chamber defined between the first wall and the second wall and connecting the seventh side fluid chamber and the eighth side fluid chamber, and (iv) a fourth bonded region where the interior surface of the first wall is bonded to the interior surface of the second wall, the fourth bonded region separating the seventh side fluid chamber and the eighth side fluid chamber and extending continuously from the fourth free end fluid chamber to the base region.

5. The glove according to claim 4, wherein the third bonded region includes: (i) a third longitudinal bonded portion extending continuously from the third free end fluid chamber to the base region, the third longitudinal bonded portion being located between and separating the fifth side fluid chamber and the sixth side fluid chamber, (ii) a sixth knuckle-flexion bonded portion extending across and intersecting the third longitudinal bonded portion at a sixth longitudinal location located within the third digit-receiving compartment, (iii) a seventh knuckle-flexion bonded portion separated from the sixth knuckle-flexion bonded portion, the seventh knuckle-flexion bonded portion extending across and intersecting the third longitudinal bonded portion at a seventh longitudinal location located within the third digit-receiving compartment, wherein the seventh longitudinal location is located a greater distance from the third free end fluid chamber than is the sixth longitudinal location, and (iv) an eighth knuckle-flexion bonded portion separated from the sixth knuckle-flexion bonded portion and the seventh knuckle-flexion bonded portion, the eighth knuckle-flexion bonded portion extending across and intersecting the third longitudinal bonded portion at an eighth longitudinal location, wherein the eighth longitudinal location is located a greater distance from the third free end fluid chamber than is the seventh longitudinal location, and wherein the fourth bonded region includes: (i) a fourth longitudinal bonded portion extending continuously from the fourth free end fluid chamber to the base region, the fourth longitudinal bonded portion being located between and separating the seventh side fluid chamber and the eighth side fluid chamber (ii) a ninth knuckle-flexion bonded portion extending across and intersecting the fourth longitudinal bonded portion at a ninth longitudinal location located within the fourth digit-receiving compartment, (iii) a tenth knuckle-flexion bonded portion separated from the ninth knuckle-flexion bonded portion, the tenth knuckle-flexion bonded portion extending across and intersecting the fourth longitudinal bonded portion at a tenth longitudinal location located within the fourth digit-receiving compartment, wherein the tenth longitudinal location is located a greater distance from the fourth free end fluid chamber than is the ninth longitudinal location, and (iv) an eleventh knuckle-flexion bonded portion separated from the ninth knuckle-flexion bonded portion and the tenth knuckle-flexion bonded portion, the eleventh knuckle-flexion bonded portion extending across and intersecting the fourth longitudinal bonded portion at an eleventh longitudinal location, wherein the eleventh longitudinal location is located a greater distance from the fourth free end fluid chamber than is the tenth longitudinal location.

6. The glove according to claim 4, wherein the plurality of separated digit-receiving compartments includes a fifth digit-receiving compartment configured to receive only a fifth digit of a human hand, wherein open space exterior to the glove base member separates the fifth digit-receiving compartment from the first digit-receiving compartment, the second digit-receiving compartment, the third digit-receiving compartment, and the fourth digit-receiving compartment, wherein the bladder component includes a fifth digit-engaging member extending away from the base region and into the fifth digit-receiving compartment of the glove base member, the fifth digit-engaging member including: (i) a ninth side fluid chamber defined between the first wall and the second wall, (ii) a tenth side fluid chamber defined between the first wall and the second wall, (iii) a fifth free end fluid chamber defined between the first wall and the second wall and connecting the ninth side fluid chamber and the tenth side fluid chamber, and (iv) a fifth bonded region where the interior surface of the first wall is bonded to the interior surface of the second wall, the fifth bonded region separating the ninth side fluid chamber and the tenth side fluid chamber and extending continuously from the fifth free end fluid chamber to the base region.

7. The glove according to claim 6, wherein the third bonded region includes: (i) a third longitudinal bonded portion extending continuously from the third free end fluid chamber to the base region, the third longitudinal bonded portion being located between and separating the fifth side fluid chamber and the sixth side fluid chamber, (ii) a sixth knuckle-flexion bonded portion extending across and intersecting the third longitudinal bonded portion at a sixth longitudinal location located within the third digit-receiving compartment, (iii) a seventh knuckle-flexion bonded portion separated from the sixth knuckle-flexion bonded portion, the seventh knuckle-flexion bonded portion extending across and intersecting the third longitudinal bonded portion at a seventh longitudinal location located within the third digit-receiving compartment, wherein the seventh longitudinal location is located a greater distance from the third free end fluid chamber than is the sixth longitudinal location, and (iv) an eighth knuckle-flexion bonded portion separated from the sixth knuckle-flexion bonded portion and the seventh knuckle-flexion bonded portion, the eighth knuckle-flexion bonded portion extending across and intersecting the third longitudinal bonded portion at an eighth longitudinal location, wherein the eighth longitudinal location is located a greater distance from the third free end fluid chamber than is the seventh longitudinal location, wherein the fourth bonded region includes: (i) a fourth longitudinal bonded portion extending continuously from the fourth free end fluid chamber to the base region, the fourth longitudinal bonded portion being located between and separating the seventh side fluid chamber and the eighth side fluid chamber, (ii) a ninth knuckle-flexion bonded portion extending across and intersecting the fourth longitudinal bonded portion at a ninth longitudinal location located within the fourth digit-receiving compartment, (iii) a tenth knuckle-flexion bonded portion separated from the ninth knuckle-flexion bonded portion, the tenth knuckle-flexion bonded portion extending across and intersecting the fourth longitudinal bonded portion at a tenth longitudinal location located within the fourth digit-receiving compartment, wherein the tenth longitudinal location is located a greater distance from the fourth free end fluid chamber than is the ninth longitudinal location, and (iv) an eleventh knuckle-flexion bonded portion separated from the ninth knuckle-flexion bonded portion and the tenth knuckle-flexion bonded portion, the eleventh knuckle-flexion bonded portion extending across and intersecting the fourth longitudinal bonded portion at an eleventh longitudinal location, wherein the eleventh longitudinal location is located a greater distance from the fourth free end fluid chamber than is the tenth longitudinal location, and wherein the fifth bonded region includes: (i) a fifth longitudinal bonded portion extending continuously from the fifth free end fluid chamber to the base region, the fifth longitudinal bonded portion being located between and separating the ninth side fluid chamber and the tenth side fluid chamber, (ii) a twelfth knuckle-flexion bonded portion extending across and intersecting the fifth longitudinal bonded portion at a twelfth longitudinal location located within the fifth digit-receiving compartment, (iii) a thirteenth knuckle-flexion bonded portion separated from the twelfth knuckle-flexion bonded portion, the thirteenth knuckle-flexion bonded portion extending across and intersecting the fifth longitudinal bonded portion at a thirteenth longitudinal location located within the fifth digit-receiving compartment, wherein the thirteenth longitudinal location is located a greater distance from the fifth free end fluid chamber than is the twelfth longitudinal location, and (iv) a fourteenth knuckle-flexion bonded portion separated from the thirteenth knuckle-flexion bonded portion and the twelfth knuckle-flexion bonded portion, the fourteenth knuckle-flexion bonded portion extending across and intersecting the fifth longitudinal bonded portion at a fourteenth longitudinal location, wherein the fourteenth longitudinal location is located a greater distance from the fifth free end fluid chamber than is the thirteenth longitudinal location.

8. The glove according to claim 1, wherein an outermost perimeter edge of the bladder component defines a total area, and wherein a combined area of all bonded regions located within the outermost perimeter edge form from 15% to 60% of the total area.

9. The glove according to claim 1, further comprising:

a pump for introducing fluid into the bladder component; and a valve for releasing fluid from the bladder component, wherein the glove base member includes a rear base hand component structured and arranged to cover a back of a human hand, wherein a rear opening is defined through the rear base hand component, and wherein an actuator for the pump and an actuator for the valve are exposed through the rear opening.

10. The glove according to claim 1, wherein the glove base member includes a front component, a rear component, and an intermediate component located between the front component and the rear component, wherein the bladder system is included in an area between the rear component and the intermediate component, and wherein a hand-receiving chamber is defined between the front component and the intermediate component.

11. The glove according to claim 1, wherein the glove is a goalkeeper's glove.

12. The glove according to claim 1, wherein the glove base member includes a front component, a rear component, and an intermediate component located between the front component and the rear component, wherein the bladder system is included in an area between the rear component and the intermediate component, and wherein when the bladder system is placed in an inflated configuration with a wearer's digit located within the first digit-receiving compartment, the first digit-engaging member of the bladder component is structured and arranged such that material of the intermediate component displaces within the first digit-receiving compartment to engage and partially wrap the wearer's digit.

13. The glove according to claim 1, further comprising:

a pump for introducing fluid into the bladder component, wherein the glove base member includes a rear base hand component structured and arranged to cover a back of a human hand, wherein a rear opening is defined through the rear base hand component, and wherein an actuator for the pump is exposed through the rear opening.

14. The glove according to claim 1, further comprising:

a valve for releasing fluid from the bladder component, wherein the glove base member includes a rear base hand component structured and arranged to cover a back of a human hand, wherein a rear opening is defined through the rear base hand component, and wherein an actuator for the valve is exposed through the rear opening.

15. The glove according to claim 1, wherein the first wall and the second wall of the bladder component are fixed together at an outermost perimeter bond, wherein the first longitudinal bonded portion is spaced from the outermost perimeter bond and extends between segments of the outermost perimeter bond that are located within the first digit-receiving compartment, and wherein the second longitudinal bonded portion is spaced from the outermost perimeter bond and extends between segments of the outermost perimeter bond that are located within the second digit-receiving compartment.

16. A glove, comprising:

a glove base member, wherein the glove base member includes a plurality of separated digit-receiving compartments including a first digit-receiving compartment configured to receive only a first digit of a human hand and a second digit-receiving compartment configured to receive only a second digit of a human hand, wherein open space exterior to the glove base member separates the first digit-receiving compartment from the second digit-receiving compartment, and wherein outer edges of the plurality of separated digit-receiving compartments are unattached to one another; and a bladder system engaged with the glove base member, wherein the bladder system includes:

a bladder component including a first wall and a second wall, wherein the bladder component includes:

(a) a first digit-engaging member extending into the first digit-receiving compartment of the glove base member, and (b) a second digit-engaging member extending into the second digit-receiving compartment of the glove base member, the second digit-engaging member including: (i) a first side fluid chamber defined between the first wall and the second wall, (ii) a second side fluid chamber defined between the first wall and the second wall, (iii) a first free end fluid chamber defined between the first wall and the second wall and connecting the first side fluid chamber and the second side fluid chamber, and (iv) a first bonded region where an interior surface of the first wall is bonded to an interior surface of the second wall, the first bonded region separating the first side fluid chamber and the second side fluid chamber and extending in a direction away from the first free end fluid chamber, wherein the first bonded region includes: (i) a first longitudinal bonded portion extending in the direction away from the first free end fluid chamber, the first longitudinal bonded portion being located between and separating the first side fluid chamber and the second side fluid chamber, (ii) a first knuckle-flexion bonded portion extending across and intersecting the first longitudinal bonded portion at a first longitudinal location located within the second digit-receiving compartment, and (iii) a second knuckle-flexion bonded portion separated from the first knuckle-flexion bonded portion, the second knuckle-flexion bonded portion extending across and intersecting the first longitudinal bonded portion at a second longitudinal location located within the second digit-receiving compartment, wherein the second longitudinal location is located a greater distance from the first free end fluid chamber than is the first longitudinal location.

17. The glove according to claim 16, wherein the glove base member further includes a third digit-receiving compartment configured to receive only a third digit of a human hand, wherein open space exterior to the glove base member separates the third digit-receiving compartment from the first digit-receiving compartment and the second digit-receiving compartment;

wherein the bladder component further includes a third digit-engaging member extending into the third digit-receiving compartment of the glove base member, the third digit-engaging region member including: (i) a third side fluid chamber defined between the first wall and the second wall, (ii) a fourth side fluid chamber defined between the first wall and the second wall, (iii) a second free end fluid chamber defined between the first wall and the second wall and connecting the third side fluid chamber and the fourth side fluid chamber, and (iv) a second bonded region where the interior surface of the first wall is bonded to the interior surface of the second wall, the second bonded region separating the third side fluid chamber and the fourth side fluid chamber and extending in a direction away from the second free end fluid chamber, wherein the second bonded region includes: (i) a second longitudinal bonded portion extending in the direction away from the second free end fluid chamber, the second longitudinal bonded portion being located between and separating the third side fluid chamber and the fourth side fluid chamber, (ii) a third knuckle-flexion bonded portion extending across and intersecting the second longitudinal bonded portion at a third longitudinal location located within the third digit-receiving compartment, and (iii) a fourth knuckle-flexion bonded portion separated from the third knuckle-flexion bonded portion, the fourth knuckle-flexion bonded portion extending across and intersecting the second longitudinal bonded portion at a fourth longitudinal location located within the third digit-receiving compartment, wherein the fourth longitudinal location is located a greater distance from the second free end fluid chamber than is the third longitudinal location.

18. The glove according to claim 17, wherein the glove base member further includes a fourth digit-receiving compartment configured to receive only a fourth digit of a human hand, wherein open space exterior to the glove base member separates the fourth digit-receiving compartment from the first digit-receiving compartment, the second digit-receiving compartment, and the third digit-receiving compartment;

wherein the bladder component further includes a fourth digit-engaging member extending into the fourth digit-receiving compartment of the glove base member, the fourth digit-engaging member including: (i) a fifth side fluid chamber defined between the first wall and the second wall, (ii) a sixth side fluid chamber defined between the first wall and the second wall, (iii) a third free end fluid chamber defined between the first wall and the second wall and connecting the fifth side fluid chamber and the sixth side fluid chamber, and (iv) a third bonded region where the interior surface of the first wall is bonded to the interior surface of the second wall, the third bonded region separating the fifth side fluid chamber and the sixth side fluid chamber and extending in a direction away from the third free end fluid chamber, wherein the third bonded region includes: (i) a third longitudinal bonded portion extending in the direction away from the third free end fluid chamber, the third longitudinal bonded portion being located between and separating the fifth side fluid chamber and the sixth side fluid chamber, (ii) a fifth knuckle-flexion bonded portion extending across and intersecting the third longitudinal bonded portion at a fifth longitudinal location located within the fourth digit-receiving compartment, and (iii) a sixth knuckle-flexion bonded portion separated from the fifth knuckle-flexion bonded portion, the sixth knuckle-flexion bonded portion extending across and intersecting the third longitudinal bonded portion at a sixth longitudinal location located within the fourth digit-receiving compartment, wherein the sixth longitudinal location is located a greater distance from the third free end fluid chamber than is the fifth longitudinal location.

19. The glove according to claim 18, wherein the glove base member further includes a fifth digit-receiving compartment configured to receive only a fifth digit of a human hand, wherein open space exterior to the glove base member separates the fifth digit-receiving compartment from the first digit-receiving compartment, the second digit-receiving compartment, the third digit-receiving compartment, and the fourth digit-receiving compartment;

wherein the bladder component further includes a fifth digit-engaging member extending into the fifth digit-receiving compartment of the glove base member, the fifth digit-engaging member including: (i) a seventh side fluid chamber defined between the first wall and the second wall, (ii) an eighth side fluid chamber defined between the first wall and the second wall, (iii) a fourth free end fluid chamber defined between the first wall and the second wall and connecting the seventh side fluid chamber and the eighth side fluid chamber, and (iv) a fourth bonded region where the interior surface of the first wall is bonded to the interior surface of the second wall, the fourth bonded region separating the seventh side fluid chamber and the eighth side fluid chamber and extending in a direction away from the fourth free end fluid chamber, wherein the fourth bonded region includes: (i) a fourth longitudinal bonded portion extending in the direction away from the fourth free end fluid chamber, the fourth longitudinal bonded portion being located between and separating the seventh side fluid chamber and the eighth side fluid chamber (ii) a seventh knuckle-flexion bonded portion extending across and intersecting the fourth longitudinal bonded portion at a seventh longitudinal location located within the fifth digit-receiving compartment, and (iii) an eighth knuckle-flexion bonded portion separated from the seventh knuckle-flexion bonded portion, the eighth knuckle-flexion bonded portion extending across and intersecting the fourth longitudinal bonded portion at an eighth longitudinal location located within the fifth digit-receiving compartment, wherein the eighth longitudinal location is located a greater distance from the fourth free end fluid chamber than is the seventh longitudinal location.

20. The glove according to claim 16, wherein the first wall and the second wall of the bladder component are fixed together at an outermost perimeter bond, and wherein the first longitudinal bonded portion is spaced from the outermost perimeter bond and extends between segments of the outermost perimeter bond that are located within the first digit-receiving compartment.

* * * * *